US011118341B2

(12) United States Patent
Pirrung

(10) Patent No.: US 11,118,341 B2
(45) Date of Patent: Sep. 14, 2021

(54) MODULAR BUILDING COMPONENTS, SYSTEMS, AND METHODS THEREOF

(71) Applicant: Timothy B. Pirrung, Newport Beach, CA (US)

(72) Inventor: Timothy B. Pirrung, Newport Beach, CA (US)

( * ) Notice: Subject to any disclaimer, the term of this patent is extended or adjusted under 35 U.S.C. 154(b) by 0 days.

(21) Appl. No.: 16/746,647

(22) Filed: Jan. 17, 2020

(65) Prior Publication Data

US 2020/0149264 A1 May 14, 2020

Related U.S. Application Data

(63) Continuation of application No. 15/989,044, filed on May 24, 2018, now Pat. No. 10,538,905.
(Continued)

(51) Int. Cl.

| | |
|---|---|
| ***E04B 1/12*** | (2006.01) |
| ***E04B 1/61*** | (2006.01) |
| ***E04B 1/343*** | (2006.01) |
| ***E04H 1/02*** | (2006.01) |
| ***E04H 1/12*** | (2006.01) |
| ***E04B 5/02*** | (2006.01) |
| ***E04B 5/48*** | (2006.01) |
| ***E04C 2/284*** | (2006.01) |

(Continued)

(52) U.S. Cl.
CPC ..... *E04B 1/12* (2013.01); *E04B 1/34315* (2013.01); *E04B 1/61* (2013.01); *E04B 1/6104* (2013.01); *E04B 1/6137* (2013.01); *E04B 1/6187* (2013.01); *E04B 5/02* (2013.01); *E04B 5/026* (2013.01); *E04B 5/48* (2013.01); *E04C 2/284* (2013.01); *E04C 2/30* (2013.01); *E04C 2/521* (2013.01); *E04H 1/02* (2013.01); *E04H 1/1205* (2013.01); *E04B 2001/6195* (2013.01); *E04C 2002/004* (2013.01); *E05D 1/06* (2013.01); *E05D 7/10* (2013.01); *E05Y 2900/142* (2013.01)

(58) Field of Classification Search
None
See application file for complete search history.

(56) References Cited

U.S. PATENT DOCUMENTS 1,998,448 A * 4/1935 Crowe ..... E04B 1/34 52/220.2
3,436,881 A * 4/1969 Schlecht ..... E04B 1/6116 52/91.3

(Continued)

FOREIGN PATENT DOCUMENTS

DE 100 23 182 11/2001

*Primary Examiner* — Joshua K Ihezie
(74) *Attorney, Agent, or Firm* — Rutan & Tucker LLP; Hani Z. Sayed

(57) ABSTRACT

Disclosed is a modular building system including, in some embodiments, one or more wall panels, one or more floor panels, and one or more roof panels. The modular building components of the modular building system including the one or more wall panels, the one or more floor panels, and the one or more roof panels can faun housing or storage structures with electrical wiring, plumbing, or both wiring and plumbing. The housing or storage structures can be erected by one or more persons without a need for a plumber, an electrician, or power tools. Also disclosed is a method for erecting one or more housing or storage structure in accordance with the modular building system.

5 Claims, 19 Drawing Sheets

Related U.S. Application Data

Figure 1:
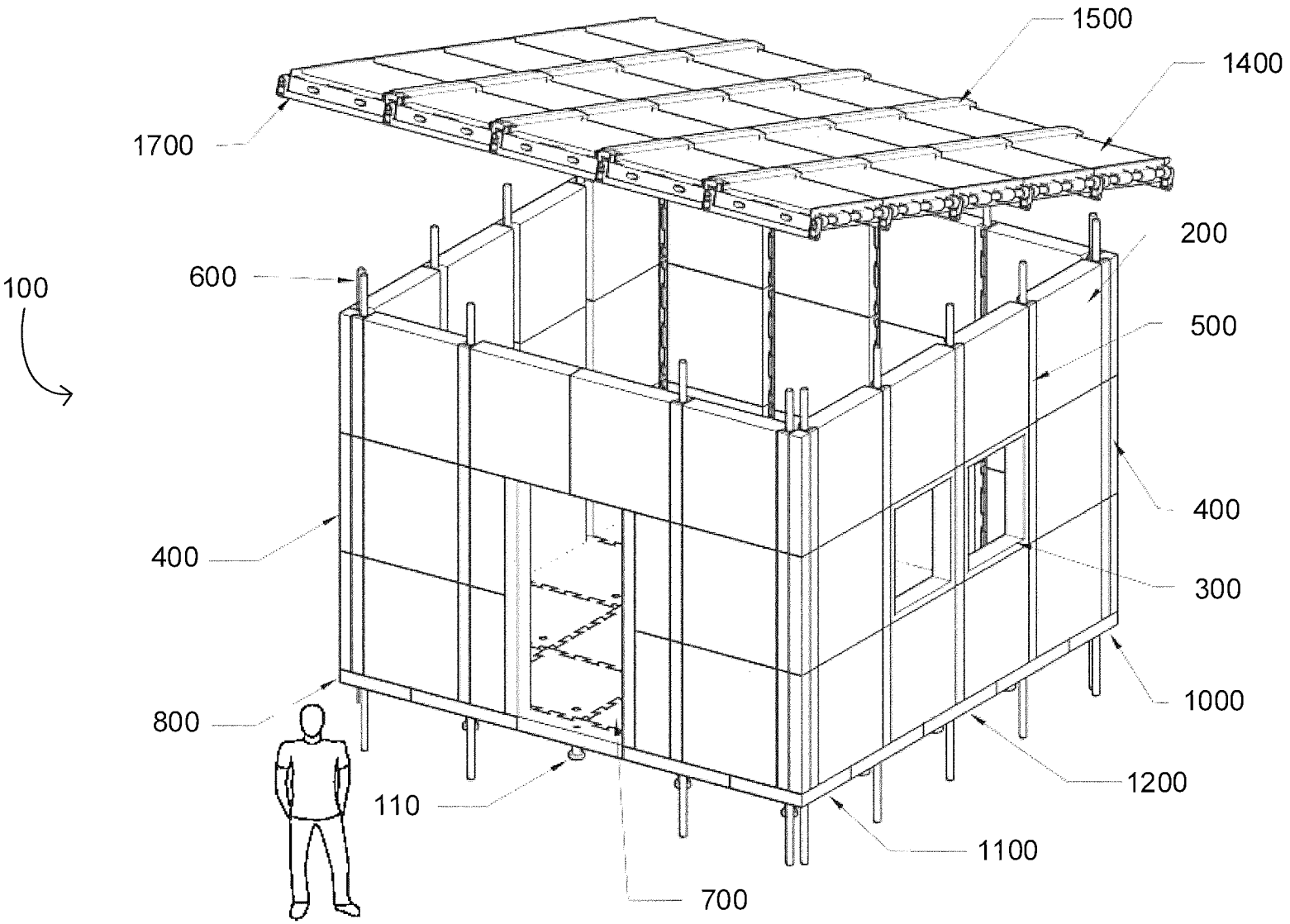

(60) Provisional application No. 62/510,677, filed on May 24, 2017.

(51) Int. Cl.

| | |
|---|---|
| ***E04C 2/30*** | (2006.01) |
| ***E04C 2/52*** | (2006.01) |
| *E05D 7/10* | (2006.01) |
| *E04C 2/00* | (2006.01) |
| *E05D 1/06* | (2006.01) |

(56) References Cited

U.S. PATENT DOCUMENTS 3,476,912 A * 11/1969 Garrison ..... E04C 2/04 219/213
3,624,977 A * 12/1971 Morton et al. ..... E04F 19/04 174/497
3,707,165 A * 12/1972 Stahl ..... E04C 2/521 137/594
3,742,666 A * 7/1973 Antoniou ..... E04C 2/521 52/220.1
3,821,818 A * 7/1974 Alosi ..... E04C 2/521 4/670
3,992,834 A * 11/1976 Valenzano ..... E04B 1/54 52/220.2
4,232,183 A * 11/1980 Person ..... E04B 2/7444 160/127
4,280,307 A * 7/1981 Griffin ..... E04B 1/0023 52/274
4,341,052 A * 7/1982 Douglass, Jr. ..... A47K 4/00 52/220.2
4,416,097 A * 11/1983 Weir ..... E04B 2/70 52/220.2
4,653,239 A * 3/1987 Randa ..... E04B 1/35 52/220.2
4,655,011 A * 4/1987 Borges ..... E03C 1/01 29/464
4,896,469 A * 1/1990 Wright ..... E04C 2/36 52/220.2
5,076,310 A * 12/1991 Barenburg ..... E04B 2/82 137/15.08
5,471,804 A * 12/1995 Winter, IV ..... E04B 1/14 403/231
5,724,773 A * 3/1998 Hall ..... E03D 11/143 52/220.1
6,076,319 A * 6/2000 Hendershot ..... E04B 1/04 52/234
6,253,521 B1 * 7/2001 Gavin ..... E04B 1/24 52/481.1
6,260,329 B1 * 7/2001 Mills ..... E04C 2/049 52/309.4
6,438,903 B1 * 8/2002 Weiss ..... E04B 1/14 52/122.1
7,690,170 B2 * 4/2010 Biffis ..... E04B 1/10 52/745.1
8,322,086 B2 * 12/2012 Weber ..... E04B 1/3431 52/79.5
8,756,878 B1 * 6/2014 Powell ..... E04C 2/30 52/169.12
9,200,447 B1 12/2015 Bargh
2002/0069600 A1 * 6/2002 Bryant ..... E04B 7/20 52/309.9
2005/0188632 A1 * 9/2005 Rosen ..... E04C 2/521 52/220.2
2005/0210764 A1 * 9/2005 Foucher ..... E04B 1/3445 52/79.5
2006/0000499 A1 * 1/2006 Livacich ..... E04H 15/04 135/90
2008/0053003 A1 3/2008 Hockemeyer et al.
2008/0115455 A1 5/2008 Nadon
2008/0168741 A1 * 7/2008 Gilgan ..... E04C 2/386 52/745.19
2009/0223144 A1 9/2009 Leahy
2010/0263308 A1 * 10/2010 Olvera ..... E04C 2/521 52/220.2
2011/0107693 A1 * 5/2011 Haskell ..... E04B 1/26 52/204.2
2011/0209735 A1 9/2011 Rowan
2011/0296778 A1 * 12/2011 Collins ..... E04B 2/72 52/220.1
2012/0317898 A1 * 12/2012 Strachan ..... E04B 1/34869 52/79.5
2013/0019549 A1 * 1/2013 Henriquez ..... E04C 2/049 52/220.2
2013/0312355 A1 * 11/2013 Padeh ..... E04B 2/00 52/584.1
2014/0013695 A1 * 1/2014 Wolynski ..... E04C 2/3405 52/426
2014/0069040 A1 3/2014 Gibson
2016/0060895 A1 * 3/2016 Skolnekovich ..... E04H 1/1205 52/281
2017/0342703 A1 * 11/2017 Peterson ..... H01R 24/28
2018/0233890 A1 * 8/2018 Van De Velde ..... H02G 1/06

* cited by examiner

MODULAR BUILDING COMPONENTS, SYSTEMS, AND METHODS THEREOF

PRIORITY

This continuation application claims the benefit of priority to U.S. patent application Ser. No. 15/989,044 filed on May 24, 2018, now issued as U.S. Pat. No. 10,538,905 issued on Jan. 21, 2020 and U.S. Provisional Patent Application No. 62/510,677, filed May 24, 2017, titled "MODULAR BUILDING COMPONENTS, SYSTEMS, AND METHODS THEREOF," which is hereby incorporated into this application by reference in its entirety.

BACKGROUND

Thousands of people become displaced each and every year due to natural disasters such as earthquakes, fires, and floods. Poverty and armed conflicts such as wars resulting from social, economic, or political elements also displace thousands of people each and every year. Such disastrous events often displace large numbers of people in very short spans of time, and those people can be displaced for months or even years. Indeed, a length of time between 4 and 12 months is a typical length of time for people in developed countries to be displaced due to natural disasters. In third-world countries, the typical length of time is between 3 and 5 years for peopled displaced due to natural disasters.

Existing solutions for temporary accommodations including tents and makeshift dwellings for disaster victims, refugees, and the homeless, have a number of problems including insufficient protection from inclement weather and inadequate security. For example, tents provide some protection against light wind and rain, but tents have insufficient protection against moderate to heavy wind and rain. And, for example, tents provide some security in the form or privacy, but tents have inadequate security against intruders. Given such problems, there is a need for temporary but secure housing for at least people displaced disastrous events.

Disclosed herein are modular building components, systems, and methods thereof that meet or exceed at least the foregoing need.

SUMMARY

Disclosed herein is a modular building system including, in some embodiments, one or more wall panels, one or more floor panels, and one or more roof panels. The modular building components of the modular building system including the one or more wall panels, the one or more floor panels, and the one or more roof panels can form housing or storage structures with electrical wiring, plumbing, or both wiring and plumbing. The housing or storage structures can be erected by one or more persons without a need for a plumber, an electrician, or power tools.

In some embodiments, each wall panel of the one or more wall panels can include an inner surface and an outer surface with foam insulation between the inner and outer surfaces.

In some embodiments, the one or more wall panels can include pre-wired wall panels. Each pre-wired wall panel of the pre-wired wall panels can include electrical wiring running through the pre-wired wall panel from a top, side, or bottom of the pre-wired wall panel. Any two of the pre-wired wall panels can fit together with a friction fit enabling one or more electrical connections between the any two of the pre-wired wall panels.

In some embodiments, the pre-wired wall panels can include pre-wired wall panels with junction boxes. Electrical wiring can run to each junction box from a side of a respective pre-wired wall panel including the junction box.

In some embodiments, the one or more wall panels can include pre-plumbed wall panels. Each pre-plumbed wall panel of the pre-plumbed wall panels can include tubing running through the pre-plumbed wall panel from a top, side, or bottom of the pre-plumbed wall panel. Tubing between any two of the pre-plumbed wall panels can fit together with quick connects enabling one or more plumbing lines of the tubing between the any two of the pre-plumbed wall panels.

In some embodiments, the one or more wall panels can include windowed wall panels. Each windowed wall panel of the windowed wall panels can include a window.

In some embodiments, each floor panel of the one or more floor panels can include an inner surface and an outer surface with structural support between the inner and outer surfaces.

In some embodiments, the structural support can include a honeycomb structure, a checkerboard structure, foam insulation, a honeycomb structure with foam insulation, or a checkerboard structure with foam insulation.

In some embodiments, the one or more floor panels can include pre-wired floor panels. Each pre-wired floor panel of the pre-wired floor panels can include electrical wiring running through the pre-wired floor panel from a side of the pre-wired floor panel. Any two of the pre-wired floor panels can fit together enabling one or more electrical connections between the any two of the pre-wired floor panels.

In some embodiments, each floor panel of the one or more floor panels can include triangle-shaped mortises formed along one or more sides of the floor panel configured for dovetailing with tenons of another floor panel.

In some embodiments, each roof panel of the one or more roof panels can include an inner surface and an outer surface with insulation between the inner and outer surfaces and a structural integrity sufficient to support a solar-power installation.

In some embodiments, the one or more roof panels can include pre-wired roof panels. Each pre-wired roof panel of the pre-wired roof panels can include electrical wiring running through the pre-wired roof panel from a side of the pre-wired roof panel. Any two of the pre-wired roof panels can fit together enabling one or more electrical connections between the any two of the pre-wired roof panels.

In some embodiments, the pre-wired roof panels can include pre-wired roof panels with light fixtures. Electrical wiring can run to each light fixture from a side of a respective pre-wired roof panel including the light fixture.

Also disclosed herein is a modular building system including, in some embodiments, one or more wall panels, one or more floor panels, and one or more roof panels. The one or more wall panels include pre-wired wall panels, pre-plumbed wall panels, or pre-wired and pre-plumbed wall panels. Each pre-wired wall panel includes electrical wiring running through the wall panel from a top, side, or bottom of the wall panel. Each pre-plumbed wall panel includes tubing running through the wall panel from a top, side, or bottom of the wall panel. At least two of the wall panels fit together enabling at least one electrical connection of the wiring or plumbing connection of the tubing between the at least two wall panels. Each pre-wired floor panel includes electrical wiring running through the floor panel from a side of the floor panel. At least two of the floor panels fit together enabling at least one electrical connection of the wiring between the at least two floor panels. Each pre-wired roof panel includes electrical wiring running through the roof panel from a side of the roof panel. At least two of the roof panels fit together enabling at least one electrical connection of the wiring between the at least two roof panels. The modular building components of the modular building system including the one or more wall panels, the one or more floor panels, and the one or more roof panels can form housing or storage structures with electrical wiring, plumbing, or both wiring and plumbing. The housing or storage structures can be erected by one or more persons without a need for a plumber, an electrician, or power tools.

In some embodiments, each floor panel of the one or more floor panels includes triangle-shaped mortises formed along one or more sides of the floor panel configured for dovetailing with tenons of another floor panel. At least the electrical wiring includes a floor-panel-to-wall-panel electrical connection and a wall-panel-to-roof-panel electrical connection. Optionally, the floor-panel-to-wall-panel and wall-panel-to-roof-panel electrical connections are part of a same circuit.

Also disclosed herein is a method for erecting a housing or storage structure with a modular building system including, in some embodiments, unpacking a kit including wall panels, floor panels, and roof panels and connecting the panels to each other to form the housing or storage structure. The method further includes spreading out a footprint guide of the housing or storage structure and inserting pipes a certain depth into the ground such that the pipes are about perpendicular with the ground around the footprint. When connecting the panels to each other to form the housing or storage structure, the panels are also connected to the pipes. Notably, modular building components of the modular building system including the wall panels, the floor panels, and the roof panels connect to each other and the pipes to form the housing or storage structure without a need for power tools.

In some embodiments, connecting the panels to each other includes first connecting the floor panels to each other to form a floor of the housing or storage structure.

In some embodiments, connecting the panels to each other further includes connecting the wall panels to the floor panels after forming the floor of the housing or storage structure.

In some embodiments, connecting the wall panels to the floor panels includes forming a first perimeter of connected wall panels on the floor before forming a second perimeter of connected wall panels over the first perimeter.

In some embodiments, connecting the wall panels to the floor panels and connecting the wall panels to other wall panels includes forming electrical connections of wiring in the panels or plumbing connections of tubing in the panels between at least two of the panels. The electrical connections of wiring and the plumbing connections of tubing do not need an electrician or a plumber, respectively, to make the connections.

These and other features of the concepts provided herein will become more apparent to those of skill in the art in view of the accompanying drawings and following description, which disclose particular embodiments of such concepts in greater detail.

DRAWINGS

FIG. 1 provides a housing or storage structure of a modular building system in accordance with some embodiments.

Figure 2A:
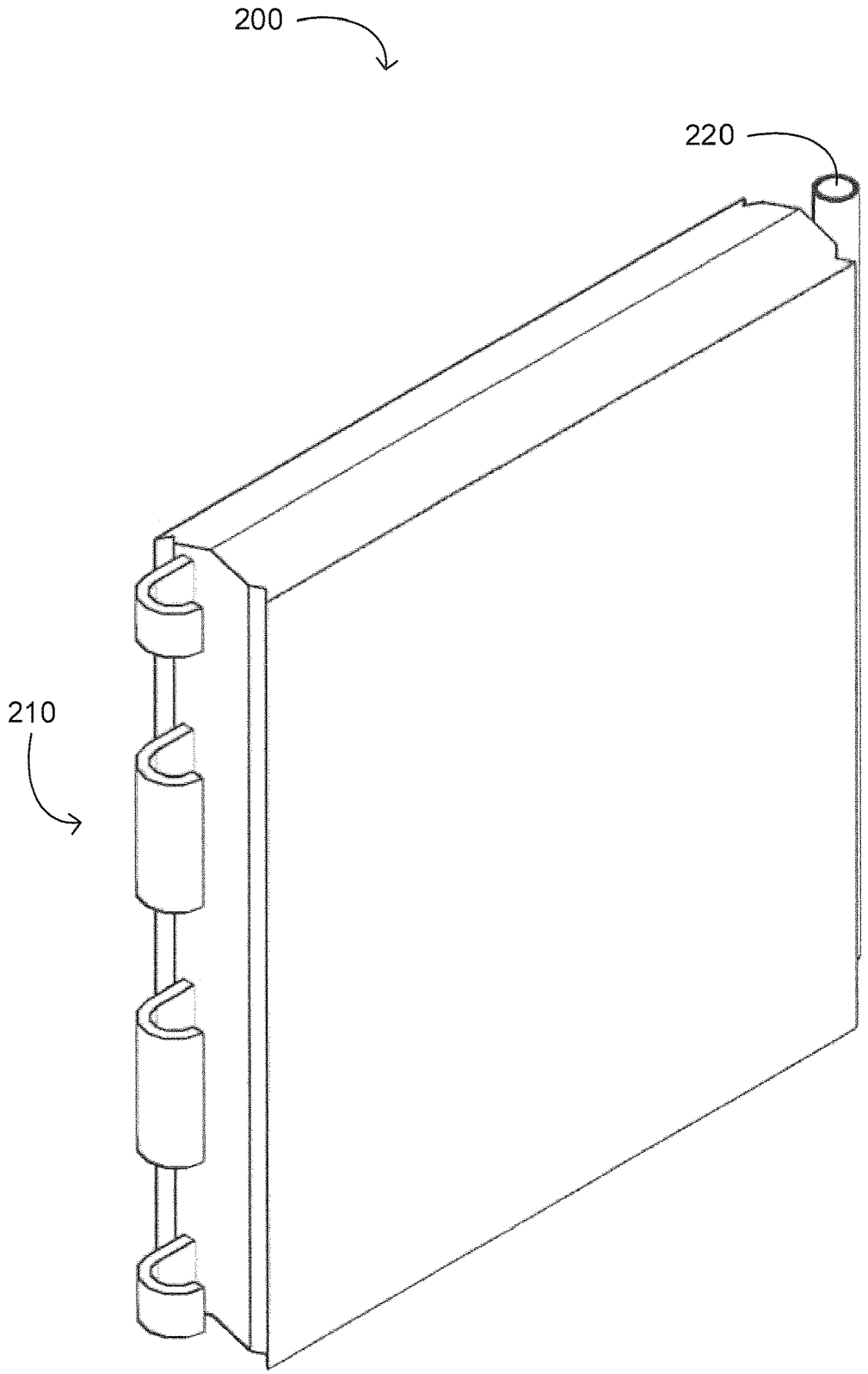

FIG. 2A provides an isometric view of a first side of a wall panel of the modular building system in accordance with some embodiments.

Figure 2B:
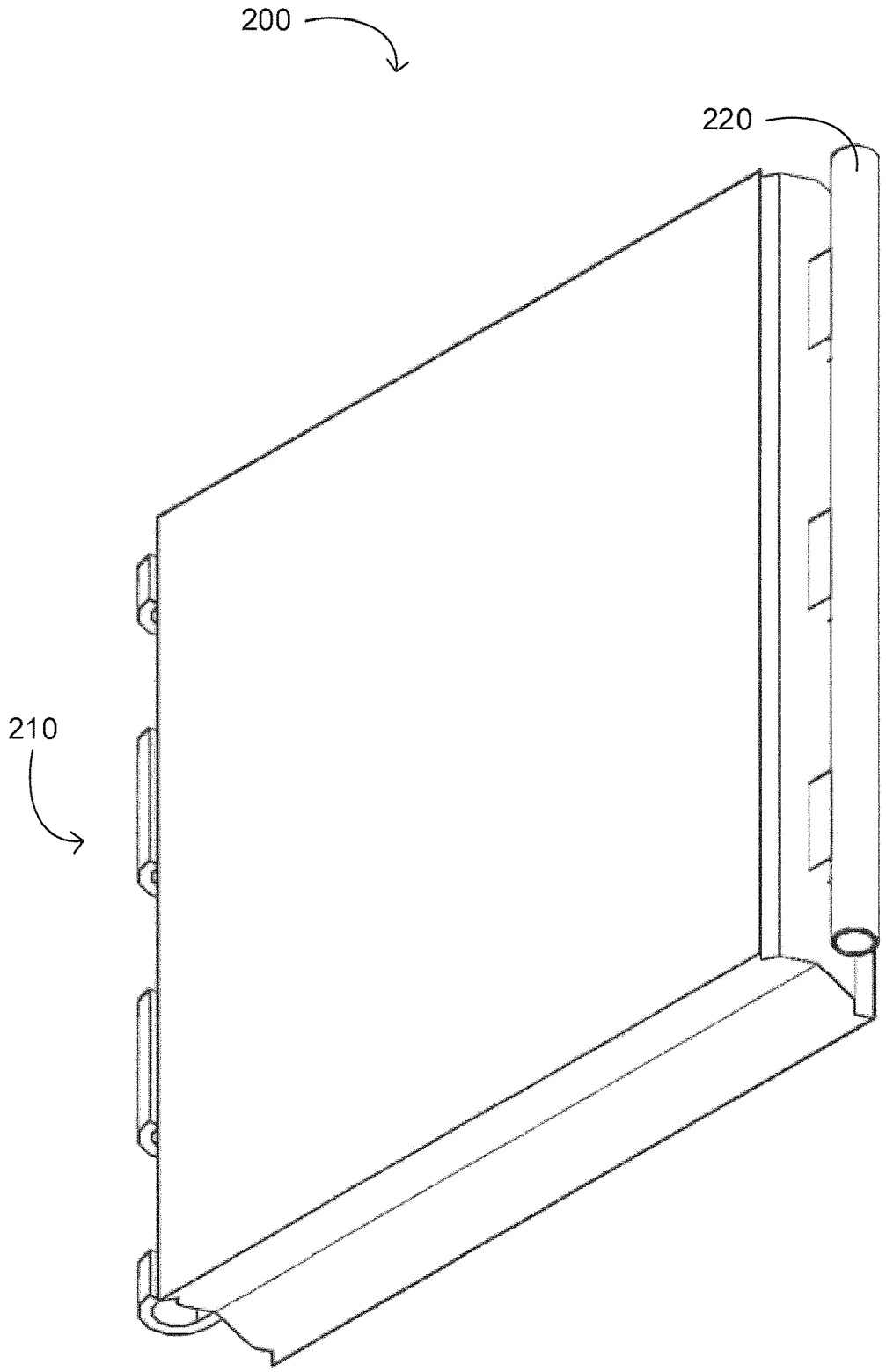

FIG. 2B provides an isometric view of a second side of the wall panel of the modular building system in accordance with some embodiments.

Figure 3A:
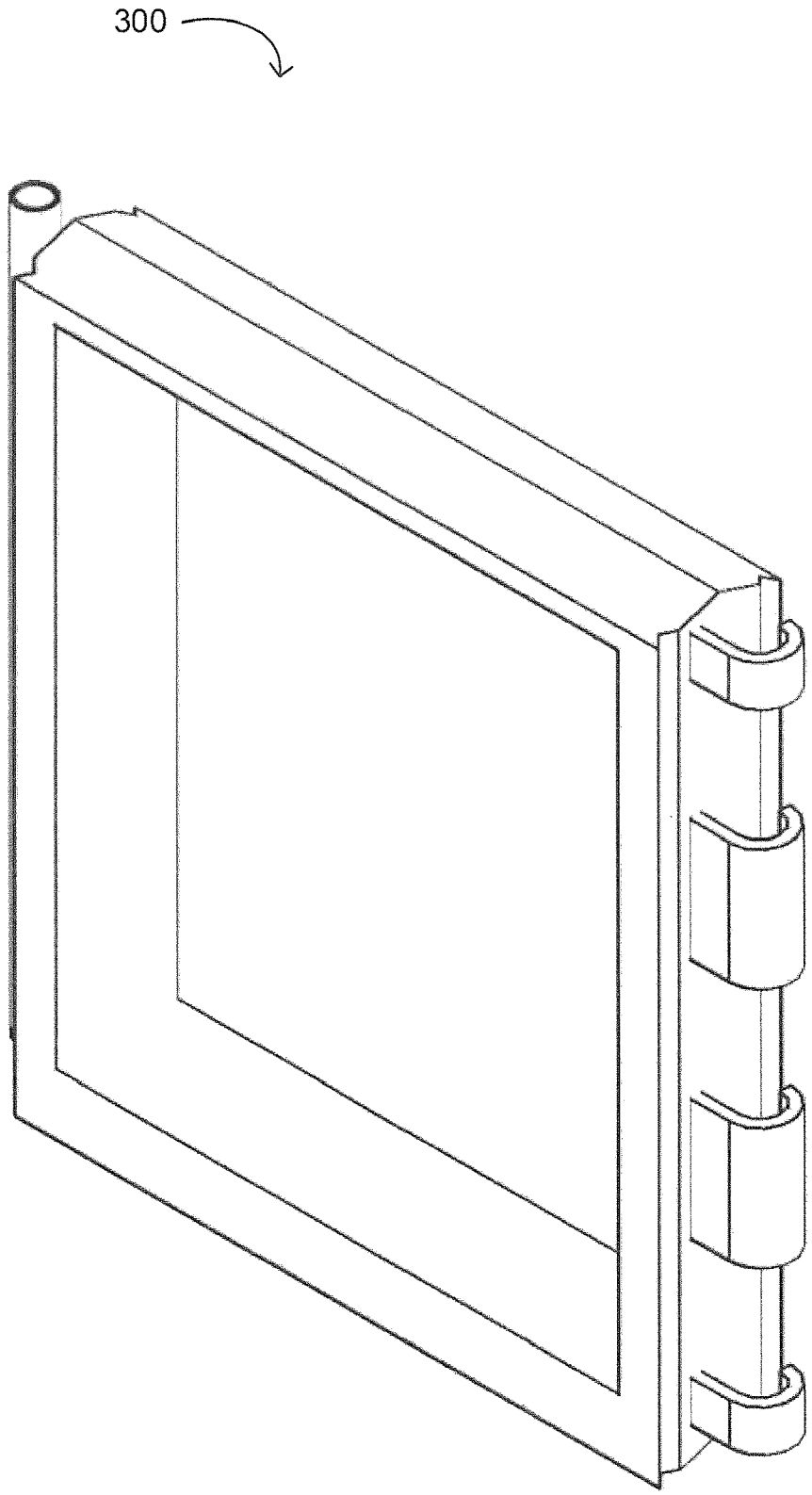

FIG. 3A provides an isometric view of a first side of a window panel of the modular building system in accordance with some embodiments.

Figure 3B:
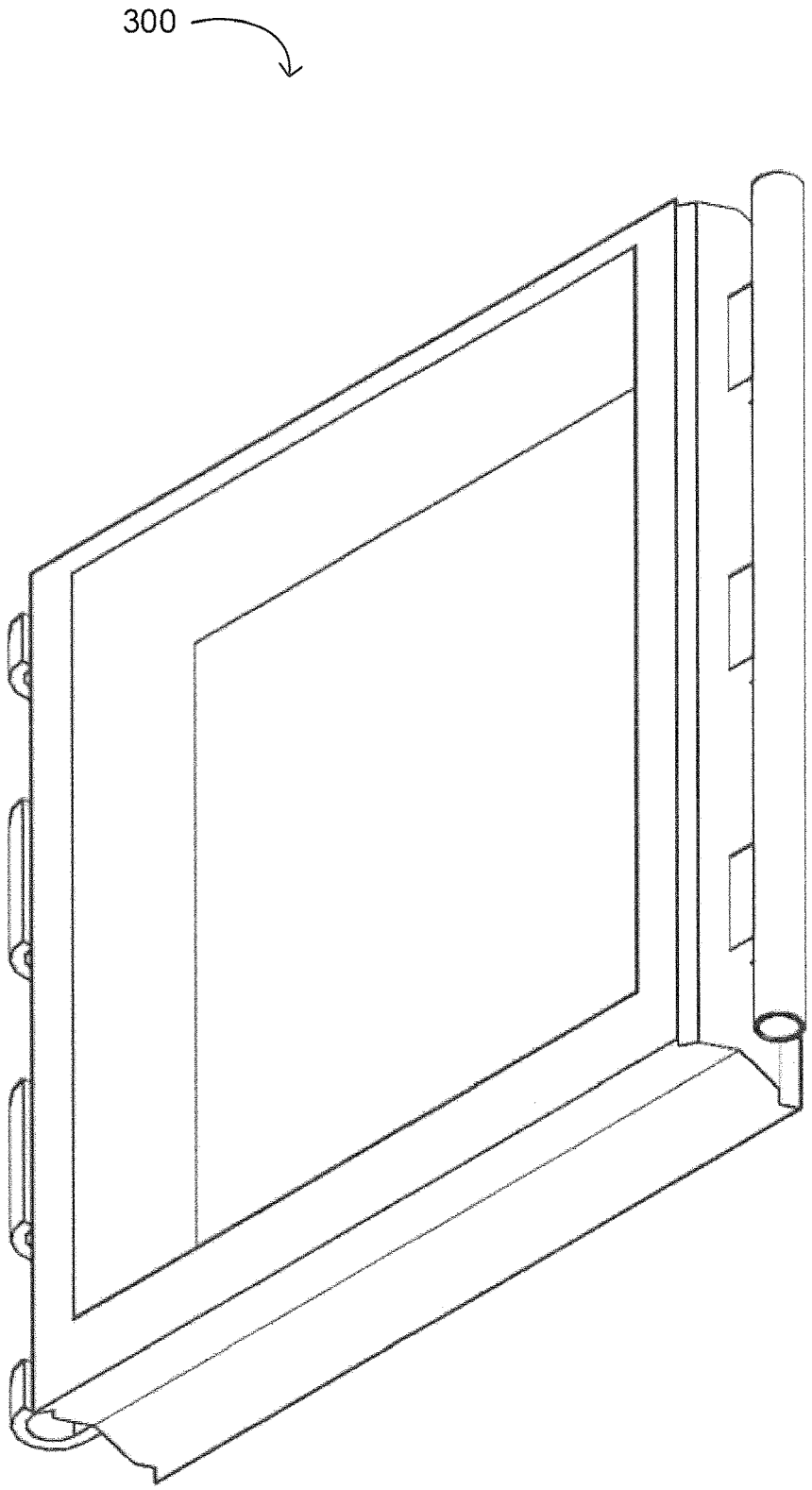

FIG. 3B provides an isometric view of a second side of the window panel of the modular building system in accordance with some embodiments.

Figure 4B:
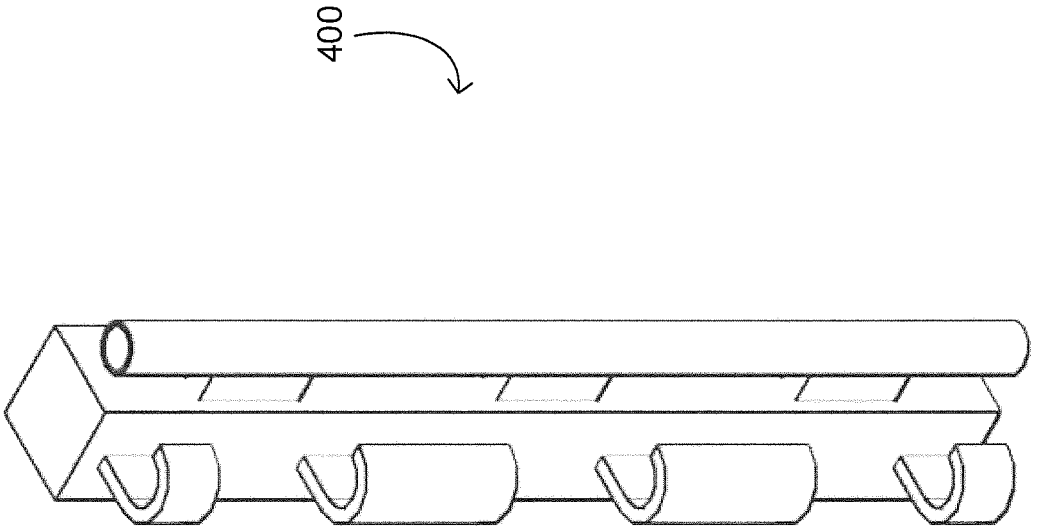
Figure 4A:
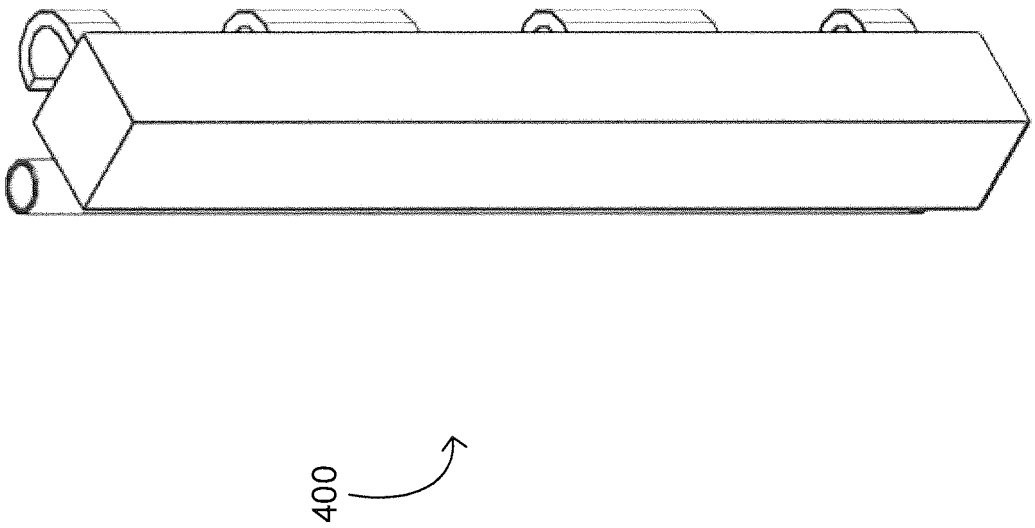

FIG. 4A provides an isometric view of a first side of a wall-corner module of the modular building system in accordance with some embodiments.

FIG. 4B provides an isometric view of a second side of the wall-corner module of the modular building system in accordance with some embodiments.

Figure 5:
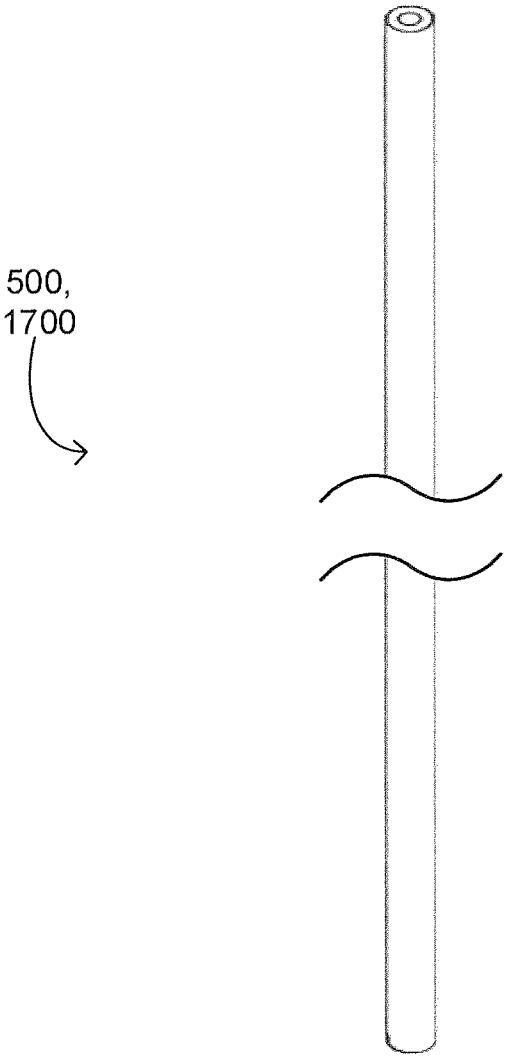

FIG. 5 provides an isometric view of a wall-pipe module or a roof-pipe module of the modular building system in accordance with some embodiments.

Figure 6:
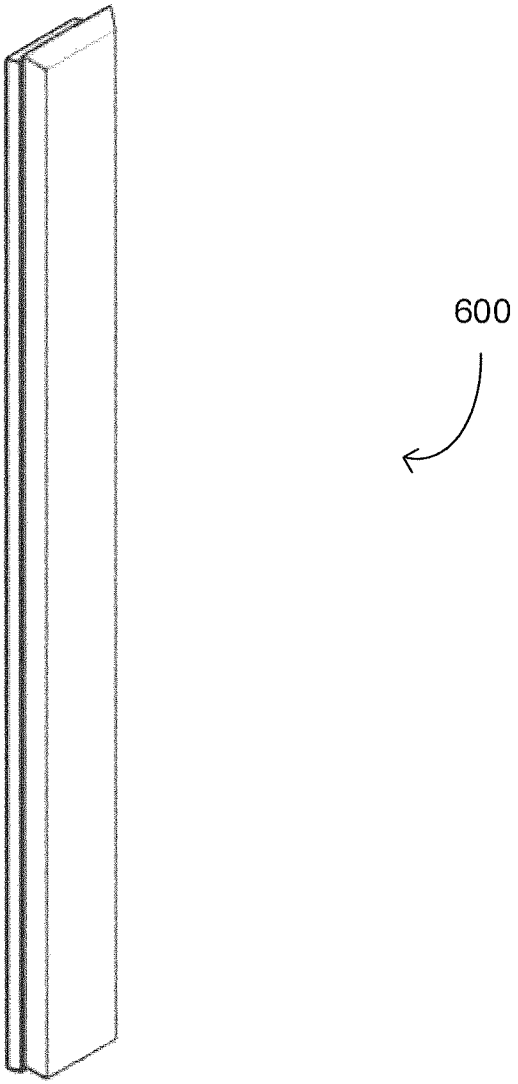

FIG. 6 provides an isometric view of one side of a wall-joint cover of the modular building system in accordance with some embodiments.

Figure 7A:
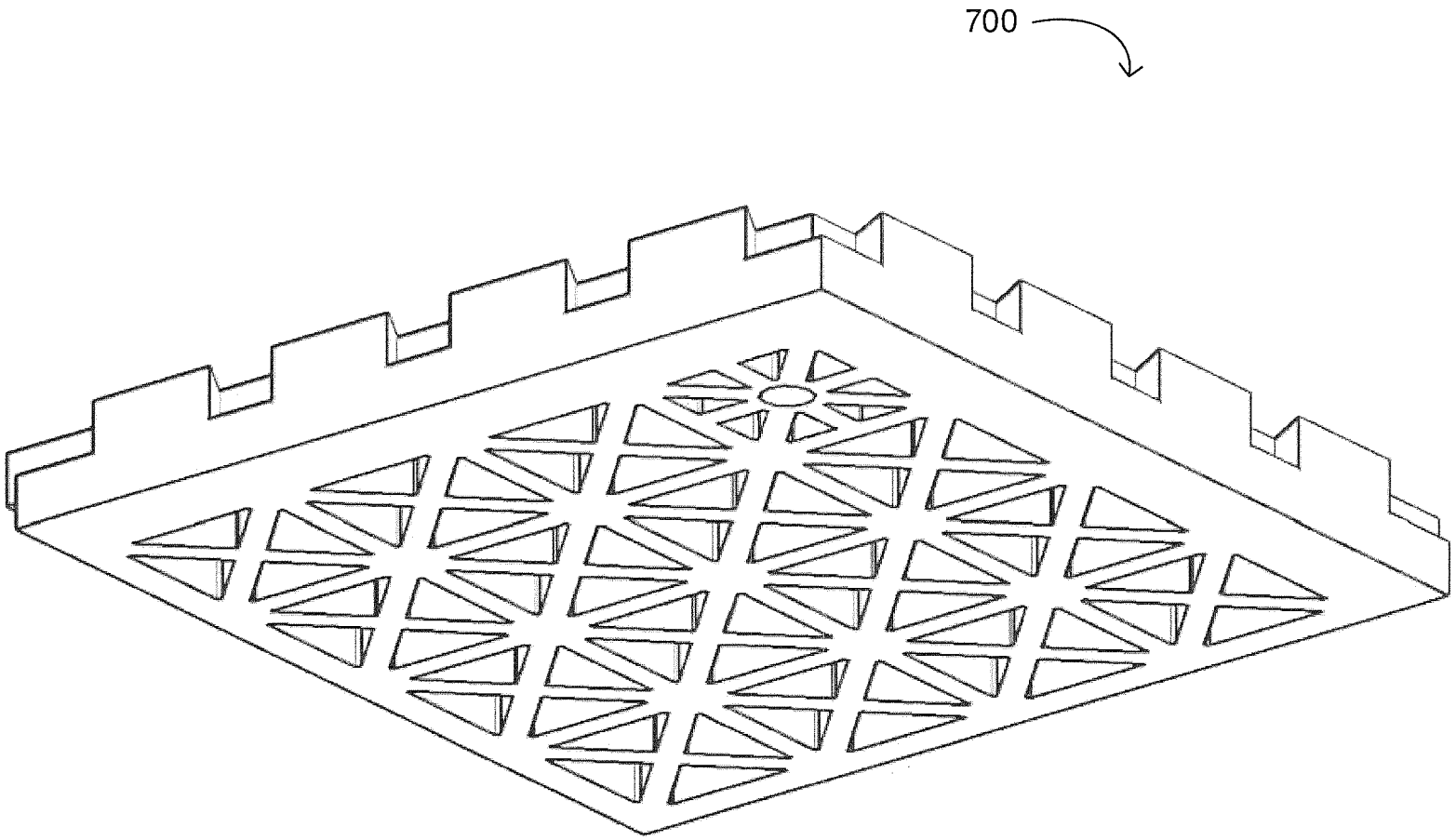

FIG. 7A provides an isometric view of a first side of a floor panel of the modular building system in accordance with some embodiments.

Figure 7B:
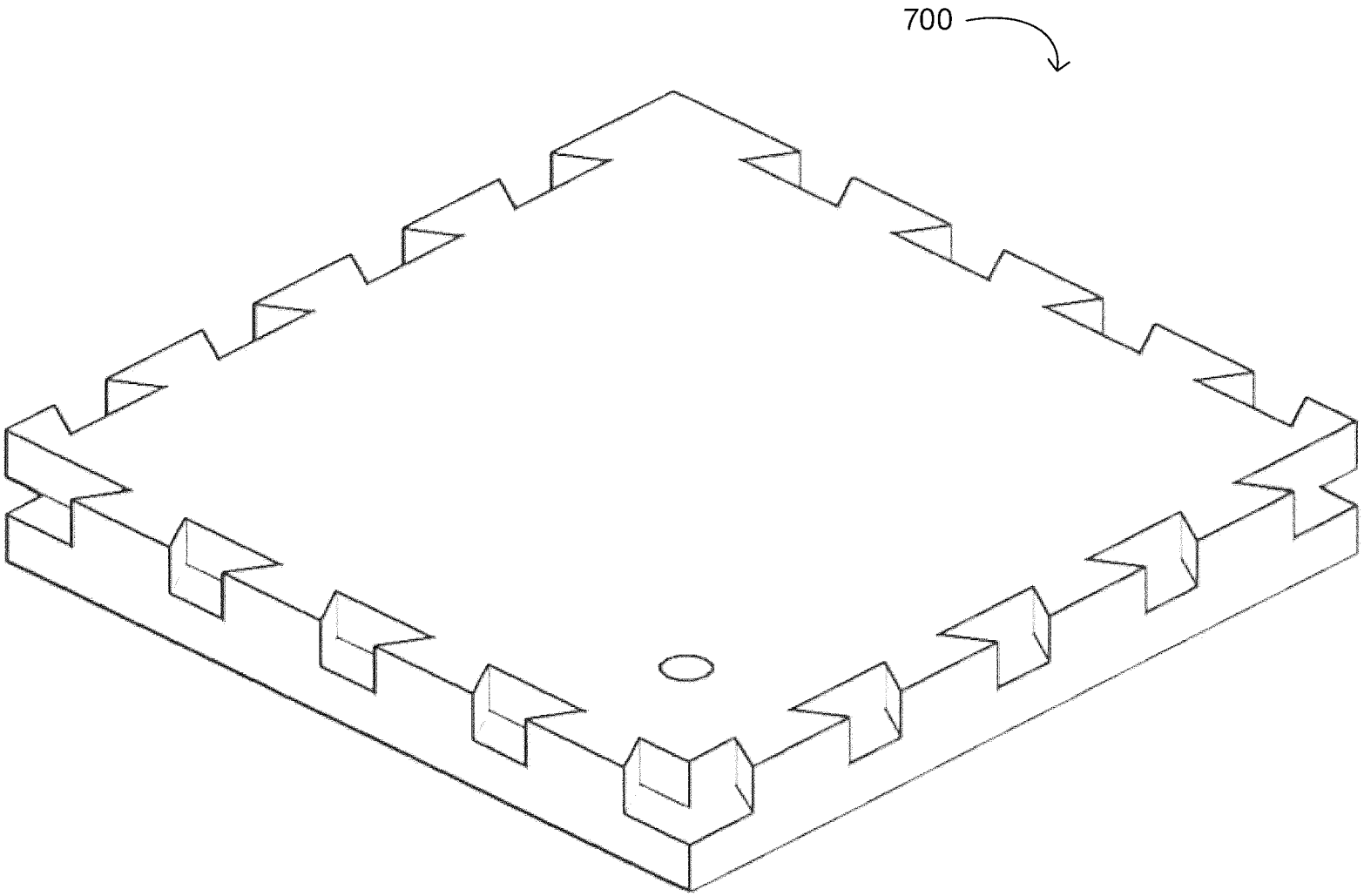

FIG. 7B provides an isometric view of a second side of the floor panel of the modular building system in accordance with some embodiments.

Figure 8A:
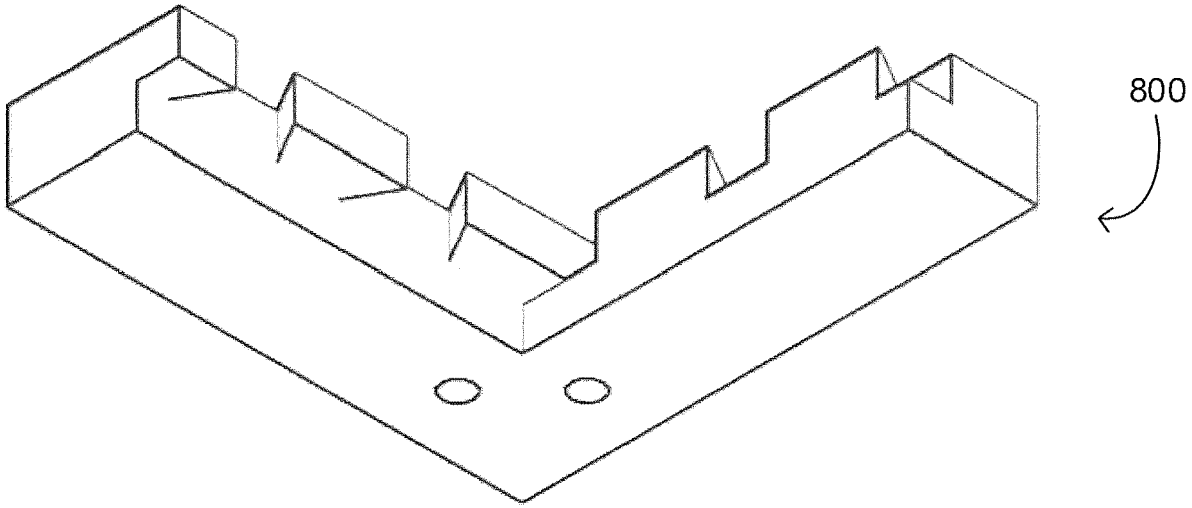

FIG. 8A provides an isometric view of a first side of a front-left floor-corner module of the modular building system in accordance with some embodiments.

Figure 8B:
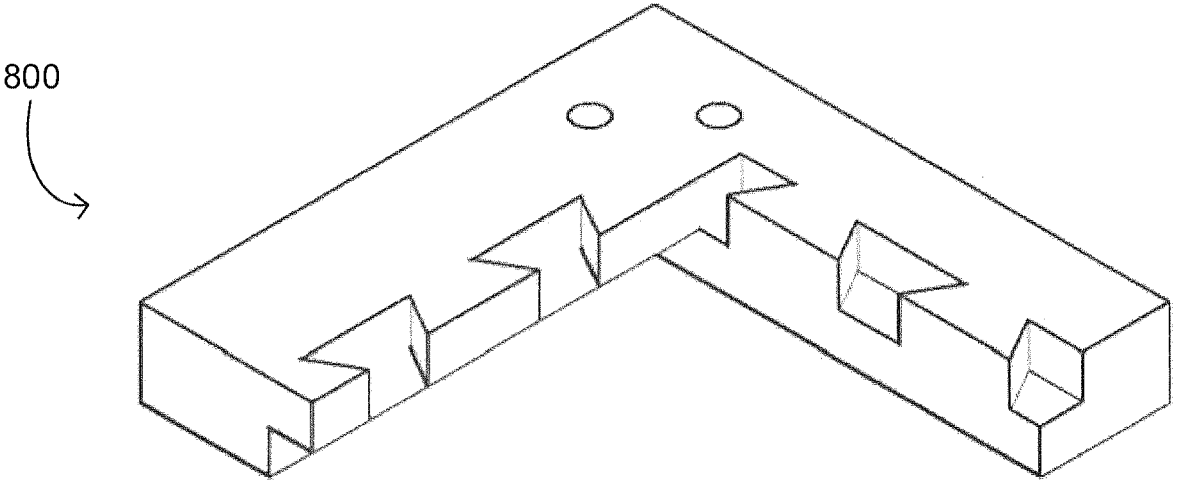

FIG. 8B provides an isometric view of a second side of the front-left floor-corner module of the modular building system in accordance with some embodiments.

Figure 9A:
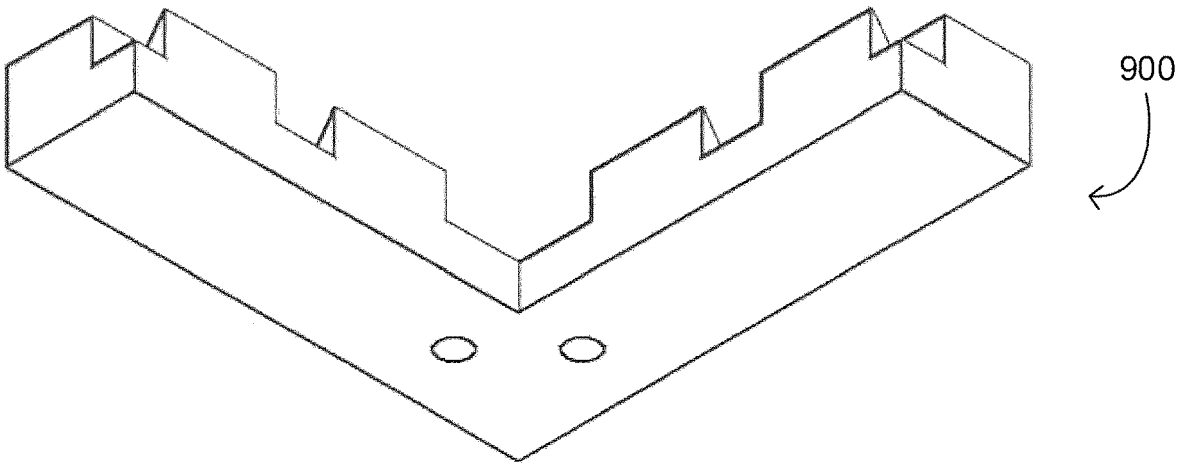

FIG. 9A provides an isometric view of a first side of a rear-left floor-corner module of the modular building system in accordance with some embodiments.

Figure 9B:
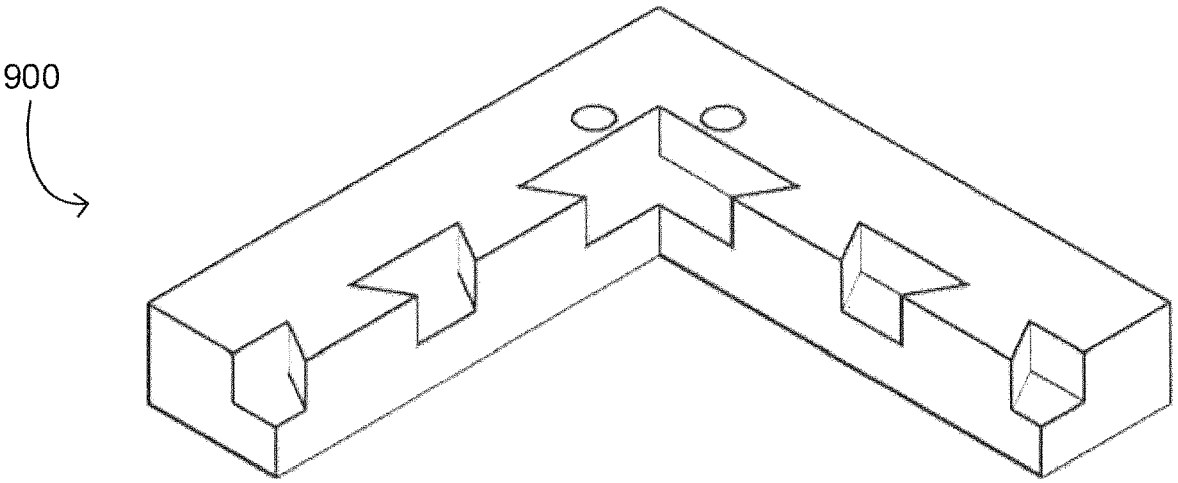

FIG. 9B provides an isometric view of a second side of the rear-left floor-corner module of the modular building system in accordance with some embodiments.

Figure 10A:
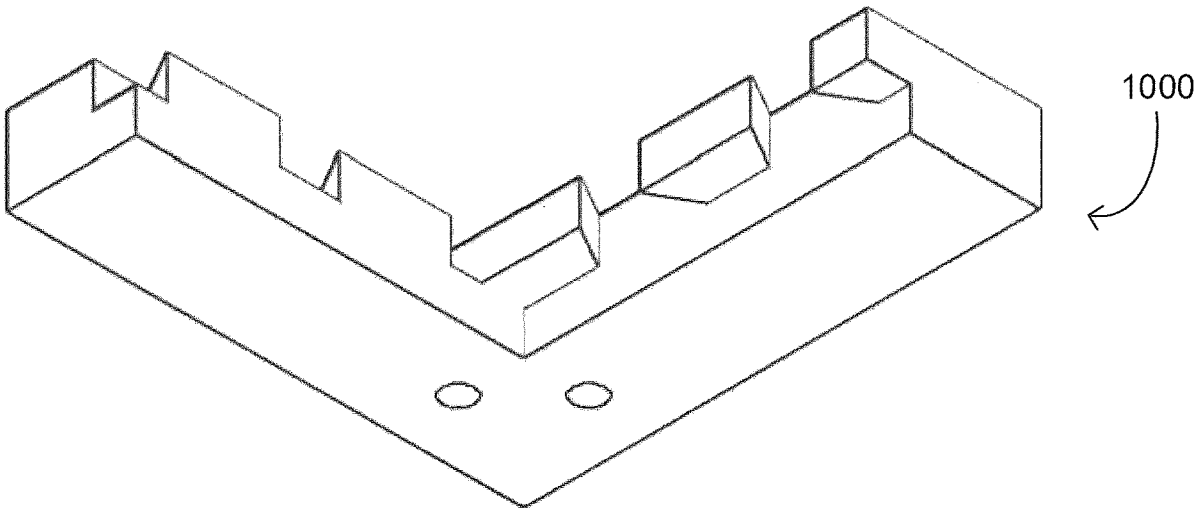

FIG. 10A provides an isometric view of a first side of a rear-right floor-corner module of the modular building system in accordance with some embodiments.

Figure 10B:
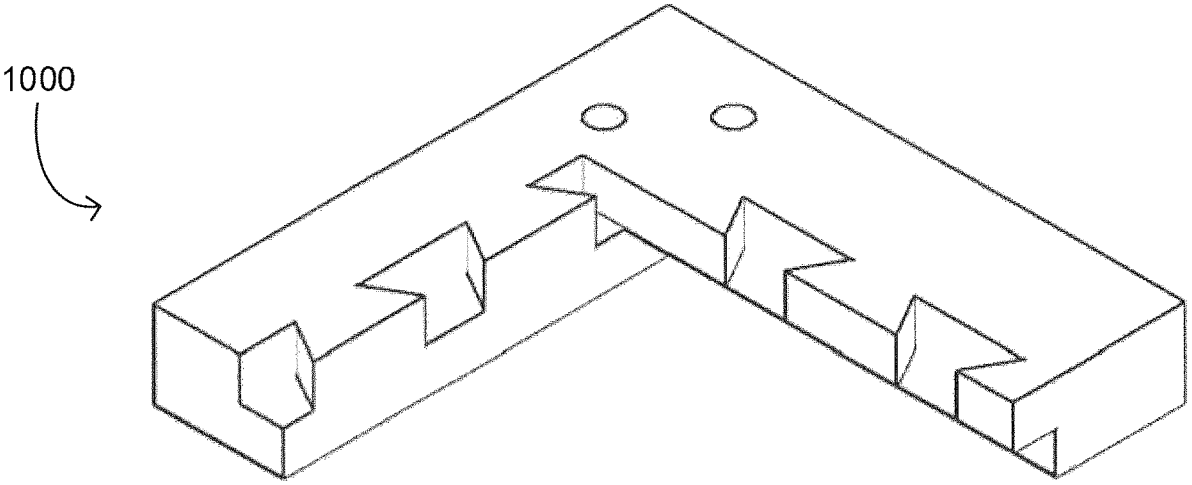

FIG. 10B provides an isometric view of a second side of the rear-right floor-corner module of the modular building system in accordance with some embodiments.

Figure 11A:
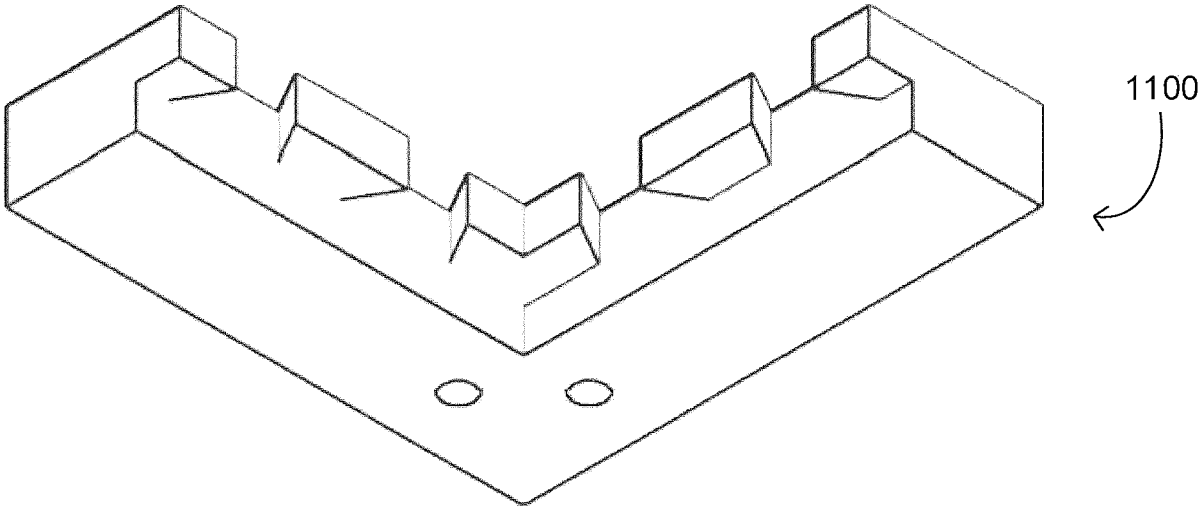

FIG. 11A provides an isometric view of a first side of a front-right floor-corner module of the modular building system in accordance with some embodiments.

Figure 11B:
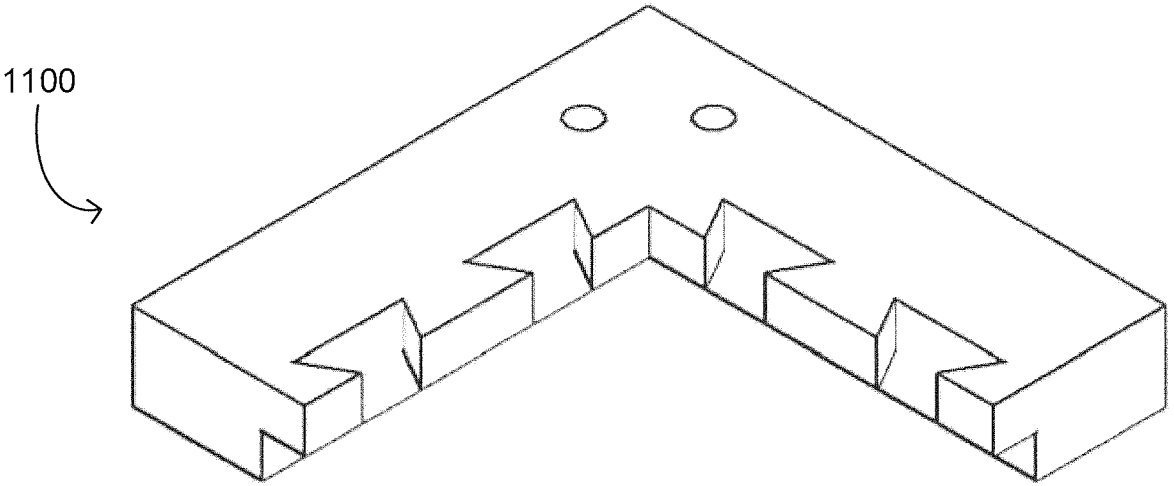

FIG. 11B provides an isometric view of a second side of the front-right floor-corner module of the modular building system in accordance with some embodiments.

Figure 12A:
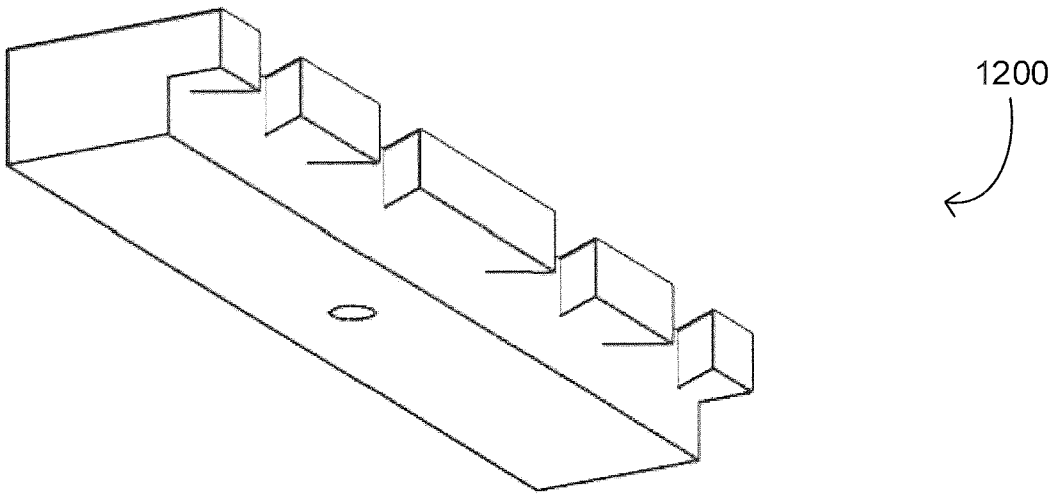

FIG. 12A provides an isometric view of a first side of a male floor-edge module of the modular building system in accordance with some embodiments.

Figure 12B:
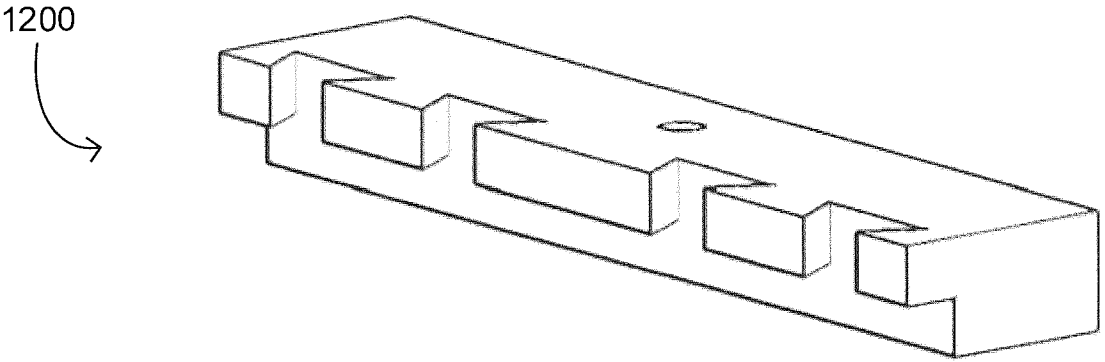

FIG. 12B provides an isometric view of a second side of the male floor-edge module of the modular building system in accordance with some embodiments.

Figure 13A:
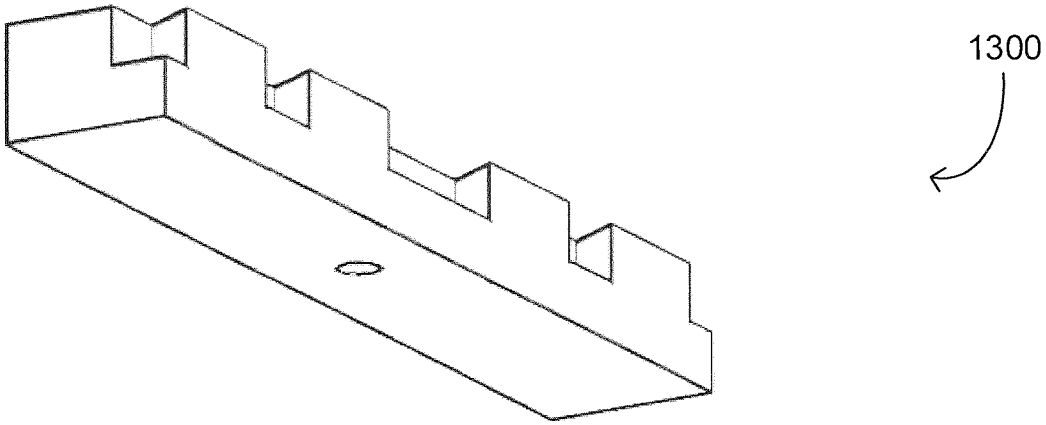

FIG. 13A provides an isometric view of a first side of a female floor-edge module of the modular building system in accordance with some embodiments.

Figure 13B:
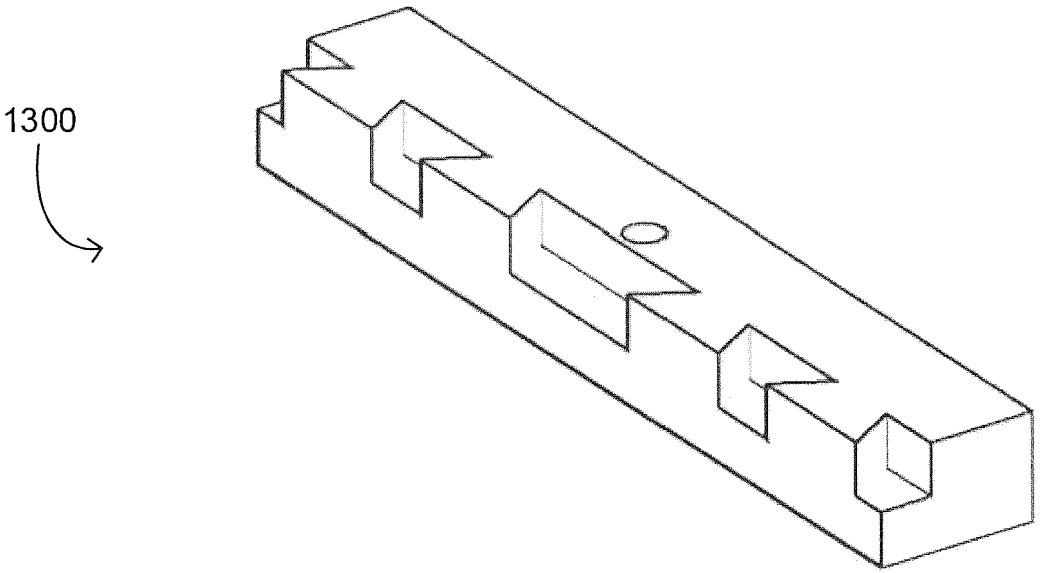

FIG. 13B provides an isometric view of a second side of the female floor-edge module of the modular building system in accordance with some embodiments.

Figure 14A:
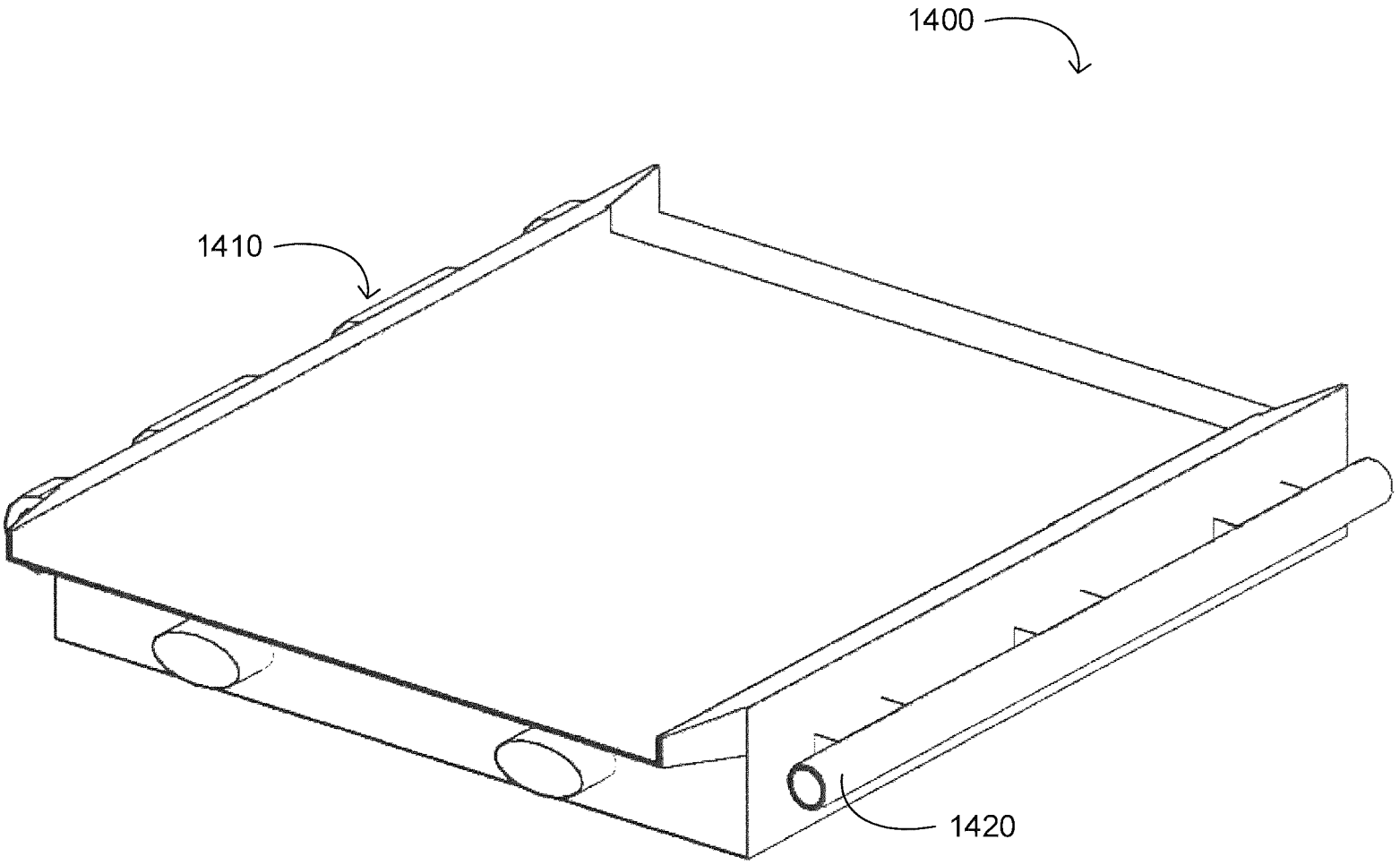

FIG. 14A provides an isometric view of a first side of a roof panel of the modular building system in accordance with some embodiments.

Figure 14B:
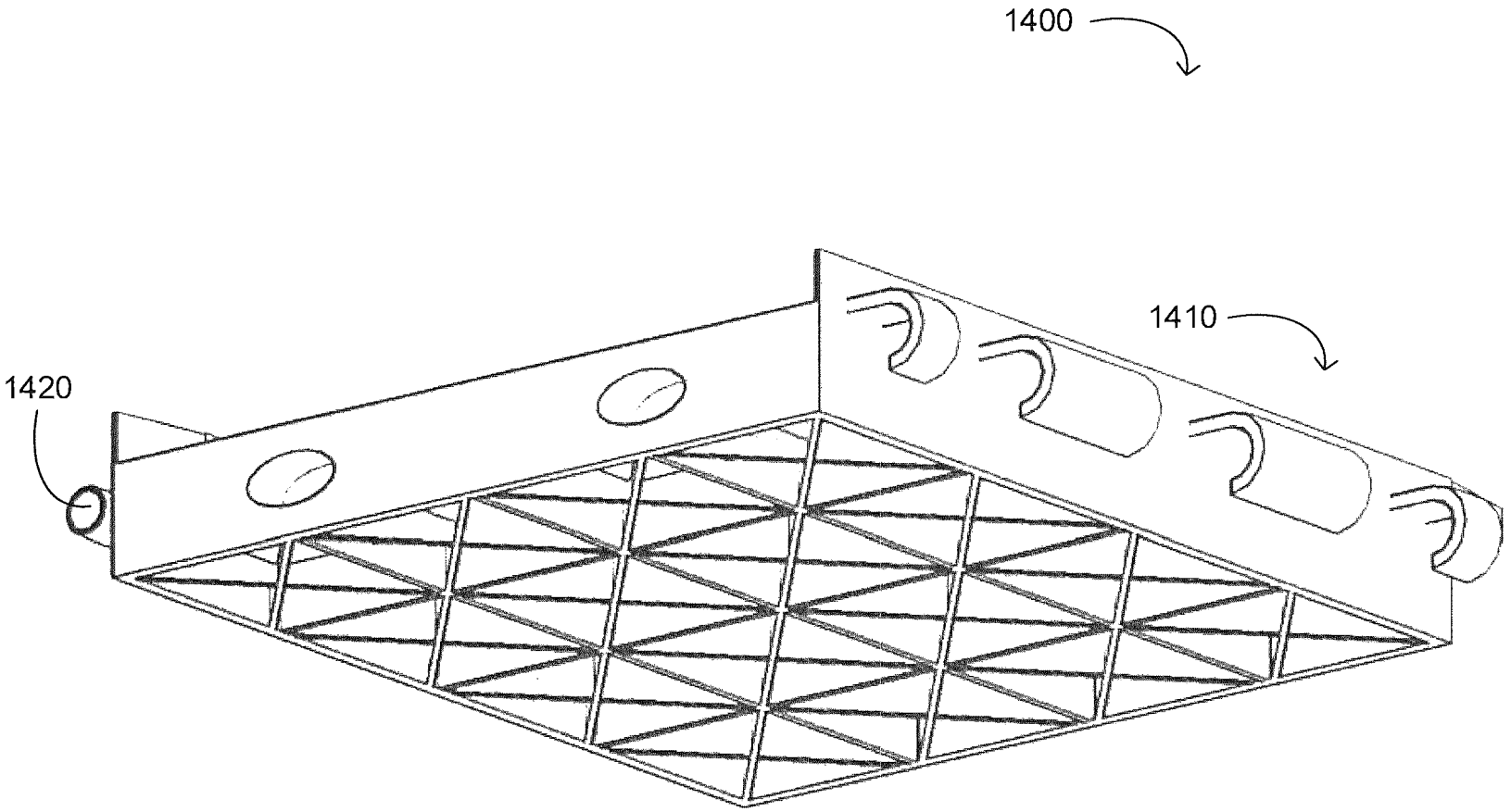

FIG. 14B provides an isometric view of a second side of the roof panel of the modular building system in accordance with some embodiments.

Figure 15A:
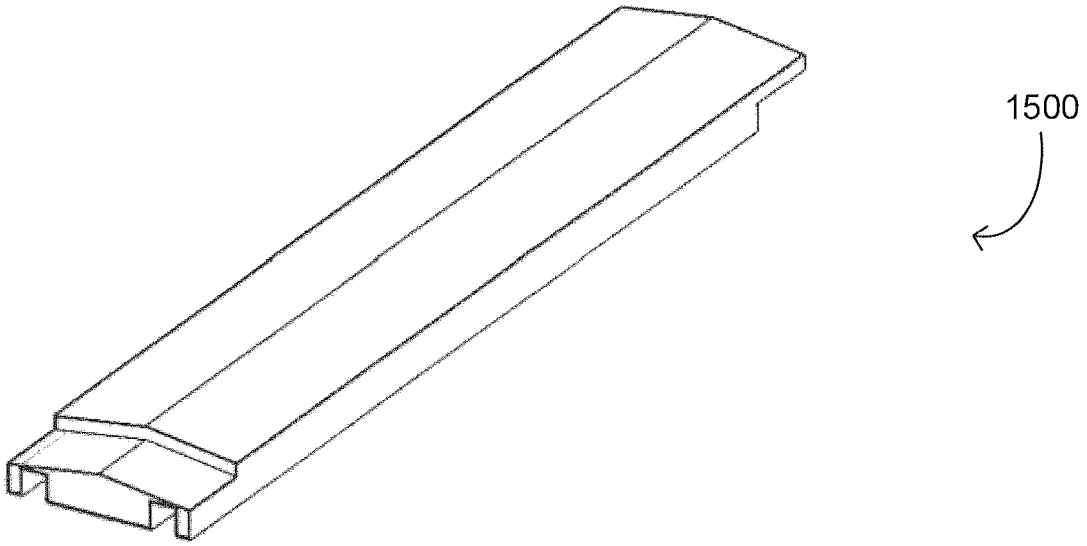

FIG. 15A provides an isometric view of a first side of a ridge module of the modular building system in accordance with some embodiments.

Figure 15B:
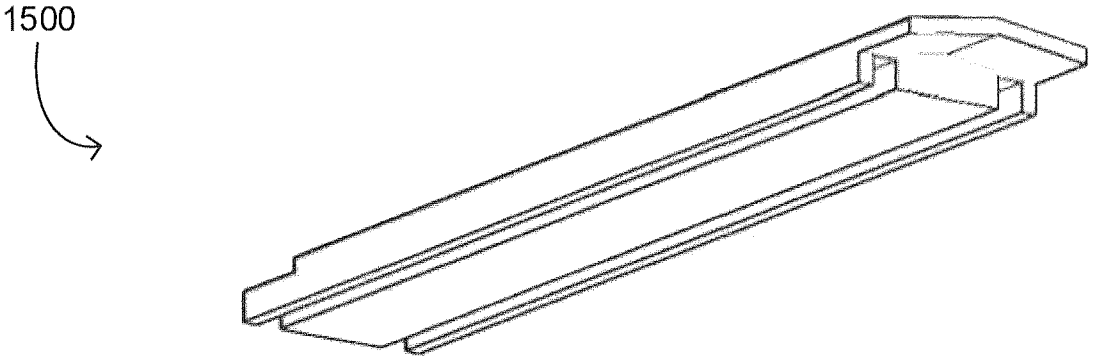

FIG. 15B provides an isometric view of a second side of the ridge module of the modular building system in accordance with some embodiments.

Figures 16A, 16B:
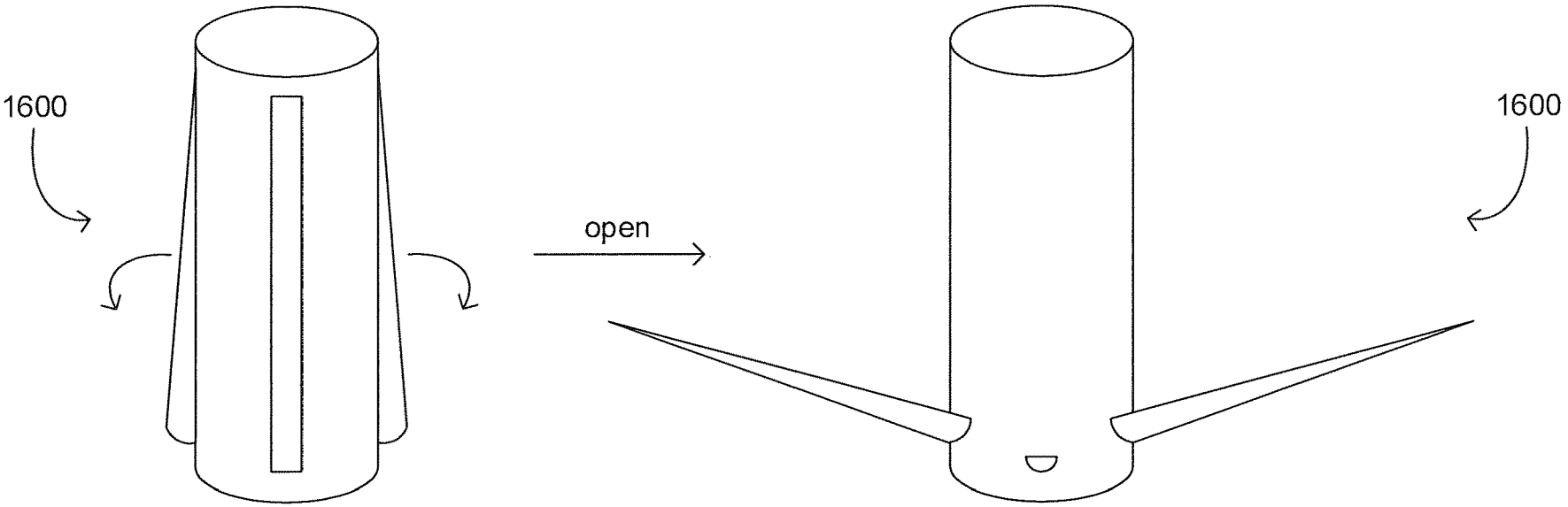

FIG. 16A provides a closed state of a spreading pipe of the modular building system in accordance with some embodiments.

FIG. 16B provides an opened or spread state of the spreading pipe of the modular building system in accordance with some embodiments.

DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "front," "back," "top," "bottom," "forward," "reverse," "clockwise," "counter clockwise," "up," "down," or the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

Unless defined otherwise, all technical and scientific terms used herein have the same meaning as commonly understood by those of ordinary skill in the art.

Again, existing solutions for temporary accommodations including tents and makeshift dwellings for disaster victims, refugees, and the homeless, have a number of problems including insufficient protection from inclement weather and inadequate security. For example, tents provide some protection against light wind and rain, but tents have insufficient protection against moderate to heavy wind and rain. And, for example, tents provide some security in the form or privacy, but tents have inadequate security against intruders. Given such problems, there is a need for temporary but secure housing for at least people displaced disastrous events.

Disclosed herein are modular building components, systems, and methods thereof that meet or exceed at least the foregoing need.

Modular Building System

FIG. 1 provides a housing or storage structure 100 of a modular building system in accordance with some embodiments.

As shown, the structure 100 of the modular building system includes one or more wall panels (e.g., wall panel 200), one or more floor panels (e.g., floor panel 700), and one or more roof panels (e.g., roof panel 1400). Such structures can be erected by one or more persons without a need for power tools. The modular building components of the modular building system including the one or more wall panels, the one or more floor panels, and the one or more roof panels can form the structure 100 or other such structures with electrical wiring, plumbing, or both wiring and plumbing.

The one or more wall panels of a structure having electrical wiring, plumbing, or both wiring and plumbing can include pre-wired wall panels, pre-plumbed wall panels, or pre-wired and pre-plumbed wall panels. Each pre-wired wall panel can include electrical wiring running through the wall panel from a top, side, or bottom of the wall panel. Each pre-plumbed wall panel can include tubing running through the wall panel from a top, side, or bottom of the wall panel. At least two of the wall panels can fit together enabling at least one electrical connection of the wiring or plumbing connection of the tubing between the at least two wall panels.

The one or more floor panels of a structure having electrical wiring, plumbing, or both wiring and plumbing can include at least pre-wired floor panels. Each pre-wired floor panel can include electrical wiring running through the floor panel from a side of the floor panel. At least two of the floor panels can fit together enabling at least one electrical connection of the wiring between the at least two floor panels.

The one or more roof panels of a structure having electrical wiring, plumbing, or both wiring and plumbing can include at least pre-wired roof panels. Each pre-wired roof panel can include electrical wiring running through the roof panel from a side of the roof panel. At least two of the roof panels can fit together enabling at least one electrical connection of the wiring between the at least two roof panels.

Each floor panel of the one or more floor panels can include triangle- or trapezoid-shaped mortises formed along one or more sides of the floor panel configured for dovetailing with tenons of another floor panel. (See, for example, FIGS. 7A and 7B.) At least the electrical wiring can include a floor-panel-to-wall-panel electrical connection and a wall-panel-to-roof-panel electrical connection. Optionally, the floor-panel-to-wall-panel and wall-panel-to-roof-panel electrical connections are part of a same circuit.

Housing or storage structures having electrical wiring, plumbing, or both wiring and plumbing can be erected by one or more persons without a need for a plumber, an electrician, or power tools. Indeed, the pre-wired, pre-plumbed, or both pre-wired and pre-plumbed panels are designed such that housing or storage structures having electrical wiring, plumbing, or both wiring and plumbing can be erected by a single person having no previous electrical or plumbing experience.

All materials used in forming modules of the modular building system can be reusable or resalable, so that any party (e.g., landowner, homeowner, school district, FEMA, UNHCR, etc.) in possession of the modules for one or more structures can simply take down and rebuild such structures in other locations. Furthermore, all materials used in forming the modules of the modular building system are chosen to minimize interference with cell phone reception from inside structures formed with the modules.

To order the modules of the modular building system, a purchasing party can enter data into a web site, a web application, or a software program at a retailer (e.g., a building supply store, a franchise, a vendor, etc.) regarding a desired structure size, as well as desired features (e.g., solar tiles or panels, electrical wiring, light fixtures, plumbing, faucets, toilets, etc.) of the structure. A list of components or modules needed can then be algorithmically produced and packaged for shipment when ordered online or for pickup at the retailer.

Each piece of the modular building system including various panels, pipes, and supporting pieces is also a module of the modular building system and can be referred to as such (e.g., wall module, floor module, roof module, pipe module, etc.) throughout this disclosure.

Wall Panels and Associated Modules

FIG. 2A provides an isometric view of a first side of a wall panel 200 of the modular building system, and FIG. 2B provides an isometric view of a second side of the wall panel 200 of the modular building system.

Each wall panel of the one or more wall panels (e.g., the wall panel 200) can include an inner surface, as shown in each figure of FIGS. 2A and 2B, and an outer surface.

Each surface of the inner and outer surfaces can be, independently, relatively thin, washable, and, optionally, slightly patterned or textured. The inner surface of a wall panel can be plastic (e.g., polycarbonate) or fiberglass, or include a veneer of plastic or fiberglass. The outer surface of a wall panel, or a veneer for the outer surface of the wall panel, can include a more rugged plastic than the inner surface such as acrylonitrile butadiene styrene ("ABS"). Veneers are useful for at least swapping out an outer surface of a wall panel for an inner surface if the wall panel is to be used for an interior wall inside a structure. Color can be, for example, white on the inner surfaces of the wall panels and gray on the outer surfaces of the wall panels.

Each wall panel of the one or more wall panels (e.g., the wall panel 200) can include elements of an interlocking system having at least an open 'C'-shaped tube and a dowel, optionally, hollowed to form an interlocking tube, respectively exemplified by 'C'-shaped tube 210 and dowel 220 of the wall panel 200 in FIGS. 2A and 2B. The open 'C'-shaped tube 210 is configured to snugly fit over the dowel 220 to make a firm attachment between sides of any two wall panels.

The interlocking system allows for rotational movement around the dowels, thereby allowing any two wall panels to form a corner of a housing or storage structure. The dowel 220, when hollowed to form the interlocking tube, can allow a rod or pipe (e.g., 1.5" rod or pipe) to pass therethrough and into the ground (e.g., every 6 feet) for vertical strength and rigidity. (See, for example, wall-pipe module 500 of FIG. 5.) Corners can be rounded to contain the three vertical elements: the 'C'-shaped tube 210, the dowel 220 hollowed to form the interlocking tube, and the rod or pipe passing therethrough. These three elements can be joined together at a corner of a housing or storage structure and covered with an outer curved cap similar to ridge module 1500 of FIG. 15B for the roof, which outer curved cap can simply be snapped in place.

A structural support can be placed between the inner and outer surfaces of a wall panel such as the wall panel 200. The structural support can include a honeycomb structure, a checkerboard structure, foam insulation, a honeycomb structure with foam insulation, or a checkerboard structure with foam insulation. Wall panels can be square panels (e.g., 36"×36" or one-meter square) with about 4-6" of foam insulation between them. Such dimensions mean that most walls can be up to about 9' high with doorways 72" (or 108")×36". If building codes require a higher doorway, a partial panel without wiring or plumbing can accommodate an 80" or 96" door.

The one or more wall panels can include pre-wired wall panels. Each pre-wired wall panel can include electrical wiring running through the wall panel from a top, side, or bottom of the wall panel. Furthermore, any pre-wired panel can include a junction box with a plate cover in the middle and aluminum wires running to and through the junction box. Electrical wiring can run to each junction box from a side of a respective pre-wired wall panel including the junction box. Any two of the pre-wired wall panels can fit together with a friction fit enabling electrical flow through one or more electrical connections between the pre-wired wall panels for outlets or wall lighting.

The one or more wall panels can include pre-plumbed wall panels. Each pre-plumbed wall panel can include tubing running through the wall panel from a top, side, or bottom of the wall panel. For example, a hot and a cold PEX (i.e., crosslinked polyethylene) water line can run vertically within a pre-plumbed wall panel with both an interior and exterior turnout, each of which turnouts can be capped when not in use. A connection for a sink or a toilet can be, for example, 36" above the floor, while a shower can be, for example, 72" above the floor. Tubing between any two of the pre-plumbed wall panels can fit together with quick connects enabling water flow through one or more plumbing lines of the tubing between the pre-plumbed wall panels.

FIG. 3A provides an isometric view of a first side of a window panel 300 of the modular building system, and FIG. 3B provides an isometric view of a second side of the window panel 300 of the modular building system.

The one or more wall panels can include windowed wall panels, or "window panels," exemplified by the window panel 300 of FIGS. 3A and 3B. Each window panel of the one or more window panels can include a window having a screened half and a sliding pane for the other half the window but otherwise includes characteristics of the foregoing wall panels.

FIG. 4A provides an isometric view of a first side of a wall-corner module 400 of the modular building system, and FIG. 4B provides an isometric view of a second side of the wall-corner module 400 of the modular building system. FIG. 5 provides an isometric view of a wall-pipe module 600 of the modular building system.

The wall-corner modules and the wall-pipe modules of the modular building system, once erected, provide a frame into which the wall panels and window panels slide, which frame can be attached to the ground through the wall-pipe modules for added stability in more permanent installations. Like the wall panels and window panels, the wall-corner modules and the wall-pipe modules are part of the interlocking system having 'C'-shaped tubes and dowels. It should be noted that, in some embodiments, the wall panels at corners of a housing or storage structure are directly connected to each other as previously described, and, in some other embodiments, the wall panels at corners of a housing or storage structure are indirectly connected to each other by way of the wall-corner modules.

With respect to attaching a frame to the ground through the wall-pipe modules for added stability in more permanent installations, this can be done at each corner and every six feet (i.e., every two wall panels) of a housing or storage structure. An end portion of the wall-pipe module 500 can be inserted in a suitably dimensioned (e.g., 1.5") hole in the ground drilled for that purpose by a hand auger, which hand augur is optionally supplied with each order. The length of the wall-pipe module 500 to be inserted into the ground can be determined by a size of the housing or storage structure above it. Alternatively, an end of the wall-pipe module 500 can be inserted in a suitably dimensioned (e.g., 1.5") spreading pipe (see spreading pipe 1600 of FIGS. 16A and 16B) in the ground opening upward. Optionally, the wall-pipe module 500 and the spreading pipe respectively include an external thread and an internal thread such that the wall-pipe module 500 can be screwed into place in the spreading pipe.

FIG. 6 provides an isometric view of one side of a wall joint cover 600 of the modular building system.

As shown in FIG. 1, the wall joint cover 600 can be used to cover the interlocking system including the open 'C'-shaped tube 210 and dowel 220 between two wall panels. This forms an aesthetically smooth exterior for a housing or storage structure, but also protects the interlocking system from environmental exposure.

Floor Panels and Associated Modules

FIG. 7A provides an isometric view of a first side of a floor panel 700 of the modular building system, and FIG. 7B provides an isometric view of a second side of the floor panel 700 of the modular building system.

Each floor panel of the one or more floor panels (e.g., the floor panel 700) can include an inner surface and an outer surface with an optional structural support between the inner and outer surfaces.

Each surface of the inner and outer surfaces can be relatively thin, but relatively thicker than the inner and outer surface of the wall panels. Each surface of the inner and outer surfaces can be washable, and, optionally, slightly patterned or textured. The inner surface of a floor panel can be plastic (e.g., polycarbonate) or fiberglass. The outer surface of a floor panel can include a more rugged plastic than the inner surface such as acrylonitrile butadiene styrene ("ABS"). Color can be, for example, white on the inner surfaces of the floor panels and gray on the outer surfaces of the floor panels.

A structural support can be placed between the inner and outer surfaces of a floor panel such as the floor panel 700. The structural support can include a honeycomb structure, a checkerboard structure, foam insulation, a honeycomb structure with foam insulation, or a checkerboard structure with foam insulation. Floor panels can be square panels (e.g., 36"×36" or one meter squared) and about 12" deep. If not including a structural support, the floor panels are mostly hollow. Otherwise, the floor panels include up to about 12" of one of the foregoing structural supports.

Each floor panel of the one or more floor panels (e.g., the floor panel 700) can include elements of an interlocking system having triangle- or trapezoid-shaped mortises formed along one or more sides of the floor panel configured for dovetailing with tenons of another floor panel. The interlocking system includes a push-down lock, so that all floor panels can be interlocked with simple downward pressure.

The one or more floor panels can include pre-wired floor panels. Each pre-wired floor panel can include electrical wiring running through the floor panel from a side of the floor panel. Any two of the pre-wired floor panels can fit together with a friction fit enabling electrical flow through one or more electrical connections between the pre-wired floor panels for outlets or wall lighting.

A threaded 2" hole can be incorporated into an upper left corner of each floor panel, into which hole can be screwed an 8"-long, 2"-wide plastic screw with a solid, rounded mushroom bottom. The top of the screw can have a square hole into which a rod with a square male end can be inserted to allow for screw-in leveling legs.

FIGS. 8A-13B provide filler modules that complement the floor modules in a number of ways when the filler modules are used. FIG. 8A provides an isometric view of a first side of a front-left floor-corner module 800 of the modular building system, and FIG. 8B provides an isometric view of a second side of the front-left floor-corner module 800 of the modular building system. FIG. 9A provides an isometric view of a first side of a rear-left floor-corner module 900 of the modular building system, and FIG. 9B provides an isometric view of a second side of the rear-left floor-corner module 900 of the modular building system. FIG. 10A provides an isometric view of a first side of a rear-right floor-corner module 1000 of the modular building system, and FIG. 10B provides an isometric view of a second side of the rear-right floor-corner module 1000 of the modular building system. FIG. 11A provides an isometric view of a first side of a front-right floor-corner module 1100 of the modular building system, and FIG. 11B provides an isometric view of a second side of the front-right floor-corner module 1100 of the modular building system. FIG. 12A provides an isometric view of a first side of a male floor-edge module 1200 of the modular building system, and FIG. 12B provides an isometric view of a second side of the male floor-edge module 1200 of the modular building system. FIG. 13A provides an isometric view of a first side of a female floor-edge module 1300 of the modular building system, FIG. 13B provides an isometric view of a second side of the female floor-edge module 1300 of the modular building system.

The filler modules such as the front-left floor-corner module 800, the rear-left floor-corner module 900, the rear-right floor-corner module 1000, the front-right floor-corner module 1100, the male floor-edge module 1200, and the female floor-edge module 1300 are configured for aesthetics of outward facing sides of the floor panels, protection of the interlocking system (e.g., mortises and tenons) at the outward facing sides of the floor panels, extension of the outward facing sides of the floor panels to meet certain variations such as whether 4" or 6" of insulation is used in the wall panels. As with the floor panels, holes can be included to accommodate leveling legs. When the leveling legs are not used, caps are used to cover the holes.

The filler modules can also be pre-wired to form pre-wired filler modules. Wherever circuits pass into a filler module, each of the filler modules can be wired with a dial connection so that one of two or more circuits can be chosen. These circuits, of which there can be up to 4, can then pass to a doorway from either side of a housing or storage structure.

Wall panels can connect to filler modules, as well as roofing panels, via snap-in-place locks. Because such snap-in-place locks might require a screwdriver for separation during removal, an optional screwdriver can be included to avoid disfiguring the modules.

Roof Panels and Associated Modules

FIG. 14A provides an isometric view of a first side of a roof panel 1400 of the modular building system, and FIG. 14B provides an isometric view of a second side of the roof panel 1400 of the modular building system. FIG. 15A provides an isometric view of a first side of a ridge module 1500 of the modular building system, and FIG. 15B provides an isometric view of a second side of the ridge module 1500 of the modular building system. FIG. 5 provides an isometric view of a roof-pipe module 1700 of the modular building system.

Each roof panel of the one or more roof panels (e.g., the roof panel 1400) can include an inner surface and an outer surface with an optional structural support between the inner and outer surfaces having a structural integrity sufficient to support a solar-power installation. Incorporation of solar panels or tiles can make an entire housing or storage structure electrically self-sufficient.

Each surface of the inner and outer surfaces can be relatively thin, but relatively thicker than the inner and outer surface of the wall panels. Each surface of the inner and outer surfaces can be washable, and, optionally, slightly patterned or textured. The inner surface of a roof panel can be plastic (e.g., polycarbonate) or fiberglass. The outer surface of a roof panel can include a more rugged plastic than the inner surface such as acrylonitrile butadiene styrene ("ABS"). Color can be, for example, white on the inner surfaces of the roof panels and gray on the outer surfaces of the roof panels.

A structural support can be placed between the inner and outer surfaces of a roof panel such as the roof panel 1400. The structural support can include a honeycomb structure, a checkerboard structure, foam insulation, a honeycomb structure with foam insulation, or a checkerboard structure with foam insulation. Roof panels can be square panels (e.g., 36"×36" or one meter squared). If not including a structural support, the roof panels are mostly hollow.

Each roof panel of the one or more roof panels (e.g., the roof panel 1400) can include elements of an interlocking system having at least an open 'C'-shaped tube and a dowel, optionally, hollowed to form an interlocking tube, respectively exemplified by 'C'-shaped tube 1410 and dowel 1420 of the roof panel 1400 in FIGS. 14A and 14B. The open 'C'-shaped tube 1410 is configured to snugly fit over the dowel 1420 to make a firm attachment between sides of any two roof panels.

The interlocking system allows for rotational movement around the dowels, thereby allowing the roof panels to adjust to any of a number of different roof pitches, which can depend upon a size (e.g., 12'×12') of the housing or storage structure. The dowel 1420, when hollowed to form the interlocking tube, can allow a rod or pipe to pass therethrough for weight, stability, fastenability at either end of the rod or pipe, or a combination thereof. (See, for example, roof-pipe module 1700 of FIG. 5.) For example, ceiling tile, a ceiling light, or both can be suspended from one or more of such rods or pipes inside a housing or storage structure.

As shown in FIG. 1, the ridge module 1500 can be used to cover the interlocking system including the open 'C'-shaped tube 1410 and dowel 1420 between two roof panels. This forms an aesthetically smooth exterior for a housing or storage structure, but also protects the interlocking system from environmental exposure. The ridge cap 1500 can be flexible enough to allow for the different roof pitches.

The one or more roof panels can include pre-wired roof panels. Each pre-wired roof panel can include electrical wiring running through the roof panel from a side of the roof panel. Any two of the pre-wired roof panels can fit together with a friction fit enabling electrical flow through one or more electrical connections between the pre-wired roof panels for outlets or ceiling lighting including light fixtures. Electrical wiring can run to each light fixture from a side of a respective pre-wired roof panel including the light fixture. A light switch to control the light fixture can be located on a wall panel, optionally on an opposite side (e.g., front vs. rear) of the housing or storage structure. Panels on opposite sides of a housing or storage structure can be on a same circuit.

Spreading Pipe for Semi-Permanent Installations

FIG. 16A provides a closed state of a spreading pipe 1600 of the modular building system, and FIG. 16B provides an opened or spread state of the spreading pipe 1600 of the modular building system.

Again, an end of the wall-pipe module 500 can be inserted in a suitably dimensioned (e.g., 1.5") spreading pipe such as the spreading pipe 1600, which spreading pipe 1600, in turn, is intended to be placed in a hole in the ground drilled for that purpose by a hand auger optionally supplied with each order. At a bottom end portion of the spreading pipe 1600, a toggle-bolt-type of attachment can be screwed. This attachment allows the spreading pipe 1600 to pass like a folded umbrella into the hole in the ground, optionally, with a rubber band around it, keeping spreaders of the spreading pipe 1600 from spreading out. Once a leveling process is completed for all four corners of a housing or storage structure, and all other points in between, the optional rubber band can be slid toward the surface of the ground with an optionally supplied small T-shaped hook to release the umbrella mechanism. Because the umbrella mechanism is not necessarily designed for retraction, spreadable pipes would most likely stay on premises unless dug up. This is especially true in more permanent installations, where a Sakrete®-and-dirt mixture can be poured into the drilled holes to fix the spreadable pipes in place.

Utility

The modular building systems disclosed herein provide temporary but protective and secure housing or storage solutions for municipalities and veterans support groups with homeless housing needs; disaster relief organizations like FEMA, UNHCR, and Red Cross with housing needs; school districts with temporary classroom needs; commercial property owners seeking to add interior walls to a warehouse, hangar, or other large structure; landowners and homeowners needing additional capacity to store objects or intermittent guests; and homeowners looking to add additional housing on their property that can be installed quickly on a temporary, semi-permanent, or permanent basis, per their wish, and could be stored, relocated or resold.

Methods

A purchasing party can interact with software either online or at retailer (e.g., at a dedicated terminal) and be guided through a number of steps to specify a size, use, or one or more additional features for one or more housing or storage structures. For example, the purchasing party can specify dimensions of a one-story housing structure having 12' sides and 36' sides to accommodate three 12'×12' rooms in a linear, ranch-style layout. Differently sized rooms are also possible as long as the dimensions of the rooms are reflect multiples of the panels sizes disclosed herein. The purchasing party can further choose features such as windows, plumbing, wiring, and internal walls.

Once all prompted selections have been made, the software can algorithmically produce a list of components or modules that are then displayed for i) the purchasing party or the retailer to collate at the retailer, ii) the retailer to collate for pickup by the purchasing party at the retailer or delivery to the purchasing party by the retailer, iii) shipment when ordered online. Depending upon the number of components or modules, as little as a pickup truck up to a number of semi-trailer trucks is needed to transport the components or modules.

On site, the purchasing party or a building party can unpack all the components and modules and drive at least four stakes inside of a perimeter of knotted string provided with the components and modules to demarcate a footprint corresponding to the housing or storage structure to be built. The building party can then true up the corners of the footprint using a provided laser device making sure the knotted string is taut in order to properly represent the footprint of the housing or storage structure.

The building party can then drop 6" disk-shaped plates provided with the components and the modules directly under the knots of the knotted string. If the ground is uneven, the building party can use a leveling bit provided on the hand auger to make a 6" flat surface for each of the 6" plates.

The building party can then drill holes in the corners of the footprint and every six feet as indicated by the knots of the knotted string with a boring bit on the hand auger. Into each hole goes a spreading pipe 1600 with the female end up. The building party can use the provided laser device to make sure each spreading pipe is at the right depth before releasing the spreaders. The depth of each spreading pipe can be rechecked using a temporarily inserted piece in the spreading pipe. If the installation is to be permanent or semi-permanent, the building party can then pour Sakrete® into the hole along with dirt to fill in the hole around each spreading pipe.

The building party can then begin to snap together the floor modules while aligning leveling stands with the 6" plates placed on the ground to obtain a level surface. If plumbing was a selected feature of the housing or storage structure, appropriate floor modules and their location are indicated by the footprint, in the instructions, or a combination thereof. The building party can then attach filler modules to the floor as shown in the instructions.

The building party can then fit wall modules together by forming a first perimeter or layer of connected wall panels on the floor having a first height before forming a second perimeter or layer of connected wall panels over the first perimeter, the second perimeter having a second height greater than the first height of the first perimeter. Thus, the wall modules are connected one layer at a time. Additionally, the wall panels are snapped into place along the perimeters of the floor as shown in the instructions for any electrical and plumbing choices selected.

With the floor and at least the first perimeter or layer of the walls of the housing or building structure constructed, the building party can then fit a threaded 9' pipe into each corner and every 6' along the walls of the housing or storage structure for additional mechanical integrity. Then the building party can start, from the doorway, to attach any remaining upper levels of wall panels, sliding the wall panels down over the pipes and attaching the corner units, in that sequence, continuing all the way around the housing or building structure. The building party can then attach the roof by connecting the roof panels.

Advantages

Advantages of the modular building systems include providing a low-cost set of interchangeable components for building simple structures; a quick construction process for one or more persons without a need for power tools; flexible, small housing solutions for displaced people (refugees, disaster victims, homeless, etc.); sturdy, weatherproof, insulated, temporary housing for such displaced people that can be easily delivered and quickly assembled; small housing or storage structures that can be quickly and easily relocated, reused, and/or resold; structures that can be transported by an individual in modular form and then erected on site in a matter of hours without power tools or mechanized equipment and that do not require the services of a plumber or electrician to be wired and plumbed; or one or more combinations thereof.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A method for erecting a housing or storage structure with a modular building system, comprising:

unpacking a kit including wall panels, floor panels, and roof panels for the housing or storage structure;

spreading out a footprint guide of the housing or storage structure;

inserting pipes a certain depth into the ground such that the pipes are about perpendicular with the ground around the footprint guide; and connecting the panels to each other and the pipes to form the housing or storage structure, wherein modular building components of the modular building system including the wall panels, the floor panels, and the roof panels connect to each other and the pipes to form the housing or storage structure without a need for power tools.

2. The method of claim 1, wherein connecting the panels to each other includes first connecting the floor panels to each other to form a floor of the housing or storage structure.

3. The method of claim 2, wherein connecting the panels to each other further includes connecting the wall panels to the floor panels after forming the floor of the housing or storage structure.

4. The method of claim 3, wherein connecting the wall panels to the floor panels includes forming a first perimeter of connected wall panels on the floor before forming a second perimeter of connected wall panels over the first perimeter.

5. The method of claim 4, wherein connecting the wall panels to the floor panels and connecting the wall panels to other wall panels includes forming electrical connections of wiring in the panels or plumbing connections of tubing in the panels between at least two of the panels, and wherein the electrical connections of wiring and the plumbing connections of tubing respectively do not need an electrician or a plumber to make the connections.

* * * * *